US009123516B2

(12) United States Patent
Hasegawa et al.

(10) Patent No.: US 9,123,516 B2
(45) Date of Patent: Sep. 1, 2015

(54) MULTIPOLE SEGMENTS ALIGNED IN AN OFFSET MANNER IN A MASS SPECTROMETER

(75) Inventors: Hideki Hasegawa, Tachikawa (JP); Masuyuki Sugiyama, Hino (JP); Hiroyuki Satake, Kokubunji (JP); Yuichiro Hashimoto, Tachikawa (JP)

(73) Assignee: HITACHI HIGH-TECHNOLOGIES CORPORATION, Tokyo (JP)

( * ) Notice: Subject to any disclaimer, the term of this patent is extended or adjusted under 35 U.S.C. 154(b) by 63 days.

(21) Appl. No.: 13/877,717

(22) PCT Filed: Oct. 3, 2011

(86) PCT No.: PCT/JP2011/005564

§ 371 (c)(1),
(2), (4) Date: May 31, 2013

(87) PCT Pub. No.: WO2012/046430

PCT Pub. Date: Apr. 12, 2012

(65) Prior Publication Data

US 2013/0240726 A1 Sep. 19, 2013

(30) Foreign Application Priority Data

Oct. 8, 2010 (JP) ..... 2010-228069

(51) Int. Cl.
*H01J 49/42* (2006.01)
*H01J 49/06* (2006.01)

(52) U.S. Cl.
CPC ..... *H01J 49/063* (2013.01); *H01J 49/4255* (2013.01)

(58) Field of Classification Search
CPC ... H01J 49/4225; H01J 49/005; H01J 49/062; H01J 49/4275
USPC ..... 250/281, 282, 292
See application file for complete search history.

(56) References Cited

U.S. PATENT DOCUMENTS

| | | | | |
|---|---|---|---|---|
| 5,847,386 | A | 12/1998 | Thomson et al. | |
| 6,111,250 | A * | 8/2000 | Thomson et al. | 250/282 |
| 6,858,840 | B2 * | 2/2005 | Berkout et al. | 250/282 |
| 7,084,398 | B2 * | 8/2006 | Loboda et al. | 250/292 |
| 2005/0242281 | A1 * | 11/2005 | Li | 250/292 |
| 2005/0279931 | A1 | 12/2005 | Franzen et al. | |
| 2007/0057178 | A1 | 3/2007 | Chernushevich et al. | |
| 2007/0057180 | A1 * | 3/2007 | Hansen et al. | 250/292 |
| 2008/0061227 | A1 | 3/2008 | Kovtoun | |
| 2008/0111067 | A1 * | 5/2008 | Glish et al. | 250/282 |

(Continued)

FOREIGN PATENT DOCUMENTS

| | | | |
|---|---|---|---|
| EP | 0 237 259 | A2 | 9/1987 |
| JP | 62-264546 | A | 11/1987 |
| JP | 11-510946 | A | 9/1999 |
| JP | 2009-508293 | A | 2/2009 |

(Continued)

*Primary Examiner* — Brooke Purinton
(74) *Attorney, Agent, or Firm* — Mattingly & Malur, PC

(57) ABSTRACT

This mass spectrometer is provided with an ion guide (37) having a multipole rod electrode (1), a power source unit (5) for applying voltage to the multipole rod electrode, and a control unit for controlling the power source unit, said mass spectrometer being characterised by the multipole rod electrode having a rod electrode divided into a plurality of segmented rods (2A-1, 2A-2, 2B-1, 2B-2, 2C-1, 2C-2, 2D-1, 2D-2) at mutually different positions in the axial direction. Thus enabled is low-cost, high-throughput analysis.

15 Claims, 22 Drawing Sheets

(56) References Cited

U.S. PATENT DOCUMENTS

2008/0315086 A1 12/2008 Kovtoun
2011/0121175 A1* 5/2011 Yasuno et al. ..... 250/292

FOREIGN PATENT DOCUMENTS

JP 2010-033735 A 2/2010
WO 2007/030923 A1 3/2007

* cited by examiner

MULTIPOLE SEGMENTS ALIGNED IN AN OFFSET MANNER IN A MASS SPECTROMETER

TECHNICAL FIELD

The present invention relates to a mass spectrometer that can perform analysis at low costs and high throughput.

BACKGROUND ART

In a mass spectrometer, MS/MS analysis in the following procedure is often performed in which ions of a specific mass are selected from ions generated at an ion source, the ions are dissociated, and a mass of fragment ions is analyzed, so that the detailed structure of a sample is identified. For example, in the case of a mass spectrometer where all of an ion transport unit (Q0), a first ion selection unit (Q1), an ion dissociation unit (Q2), and a second ion selection unit (Q3) are configured of a multipole rod electrode (typically, a quadrupole rod electrode), ions generated in an ion source are efficiently passed through Q0 by applying a radio frequency (RF) voltage to the multipole rod electrode of Q0, and introduced into Q1. Q1 is called a quadrupole mass filter (QMF) because Q1 can pass only ions of a specific mass among the introduced ions by applying an RF voltage and a direct current (DC) voltage to its multipole rod electrode. The specific ions selected and separated at Q1 are introduced into Q2. Q2 is called a collision cell because Q2 includes a function (CID: Collision Induced Dissociation) that dissociates ions by causing ions to collide against a neutral gas (such as nitrogen, helium, and argon) in the atmosphere of Q2 while passing ions by applying an RF voltage to the multipole rod electrode. The ions dissociated at Q2 are introduced into Q3. Q3 is also called a QMF because Q3 can pass ions while separating the introduced ions according to masses by applying an RF voltage and a DC voltage to the multipole rod electrode as similar to Q1. The ions separated at Q3 are ejected from an outlet according to masses, and detected at a detector.

Since general ion dissociation at Q2 is performed by causing ions to collide against a neutral gas, the ions introduced into Q2 repeat collision to slow the rate of travel, and the time of flight in Q2 is prolonged. Although depending on the length of Q2 or ion masses, generally, it takes a few milliseconds to pass ions through Q2. Therefore, it is difficult to improve the throughput of analysis.

Patent Literature 1 proposes various methods in order to shorten the ion time of flight in Q2. The detail is shown below.

(1) A multipole rod electrode is divided in the axial direction, and different DC offset voltages are applied to the divided electrodes to form an axial electric field, and then ions are accelerated and passed in the axial direction with the electric field.

(2) The multipole rod electrode is configured of a rod electrode in a tapered shape to form an axial electric field, and ions are accelerated and passed in the axial direction with the electric field.

(3) The rod electrodes of the multipole rod electrode are disposed obliquely to form an axial electric field, and ions are accelerated and passed in the axial direction with the electric field.

(4) An electrode to form an axial electric field is disposed at a position in a gap between the rod electrodes of the multipole rod electrode, and ions are accelerated and passed in the axial direction with the electric field.

(5) The multipole rod electrode is configured of a rod electrode having a resistor coating, and a potential difference is applied across the both ends of the rod electrode to form an axial electric field, and ions are accelerated and passed in the axial direction with the electric field.

CITATION LIST

Patent Literature

Patent Literature 1: U.S. Pat. No. 5,847,386

SUMMARY OF INVENTION

Technical Problem

The device configurations (1) to (5) described in Patent Literature 1 have the following problem.

(1) In order to obtain an effective axial electric field to accelerate ions, it is necessary to form a more continuous electric field. To this end, it is necessary to divide the rod electrode in shorter length. However, since it is necessary to increase the number of electrodes, wiring becomes troublesome, and assembly is also complicated, causing an increase in cost.

(2) As for the rod electrode in a tapered shape, a manufacture method for the electrode itself becomes complicated, the shapes of components to hold the electrode also becomes complicated, and it is not easy to maintain assembly accuracy.

(3) As different from a tapered rod, a manufacture method for the electrode itself is relatively simple. However, the shapes of components to hold the electrode becomes complicated, and it is not easy to maintain assembly accuracy.

(4) Since the electrode is disposed at a position in a gap between the rod electrodes, the number of component is increased, and assembly also becomes complicated, causing an increase in cost.

(5) Since it is necessary to provide a uniform film thickness of the rod electrode having a resistor coating in manufacture, manufacture costs are increased. Moreover, the rod electrode that applies an RF voltage is configured of a resistor, and a potential difference is applied across the both ends, so that a power supply configuration becomes complicated.

Solution to Problem

A representative configuration according to the present invention is a mass spectrometer including an ion guide having a multipole rod electrode. The multipole rod electrode includes a rod electrode divided into a plurality of segmented rods at positions different from each other in an axial direction.

Moreover, a power supply is individually provided to segmented rod groups formed of multipole rods, so that regions in different potential states are formed according to the positions to divide rod electrodes, not according to the number of segmented rod groups.

Advantageous Effects of Invention

According to the present invention, it is possible to implement an ion guide that can shorten the ion time of flight with a configuration in which costs can be reduced, and it is possible to perform analysis at high throughput.

DESCRIPTION OF EMBODIMENTS

First Embodiment

In a first embodiment, a configuration will be described in which in a quadrupole rod electrode that a multipole rod electrode configuring an ion guide is formed of four rod electrodes, all the rod electrodes are divided into two parts at different positions in the axial direction.

Figure 1:
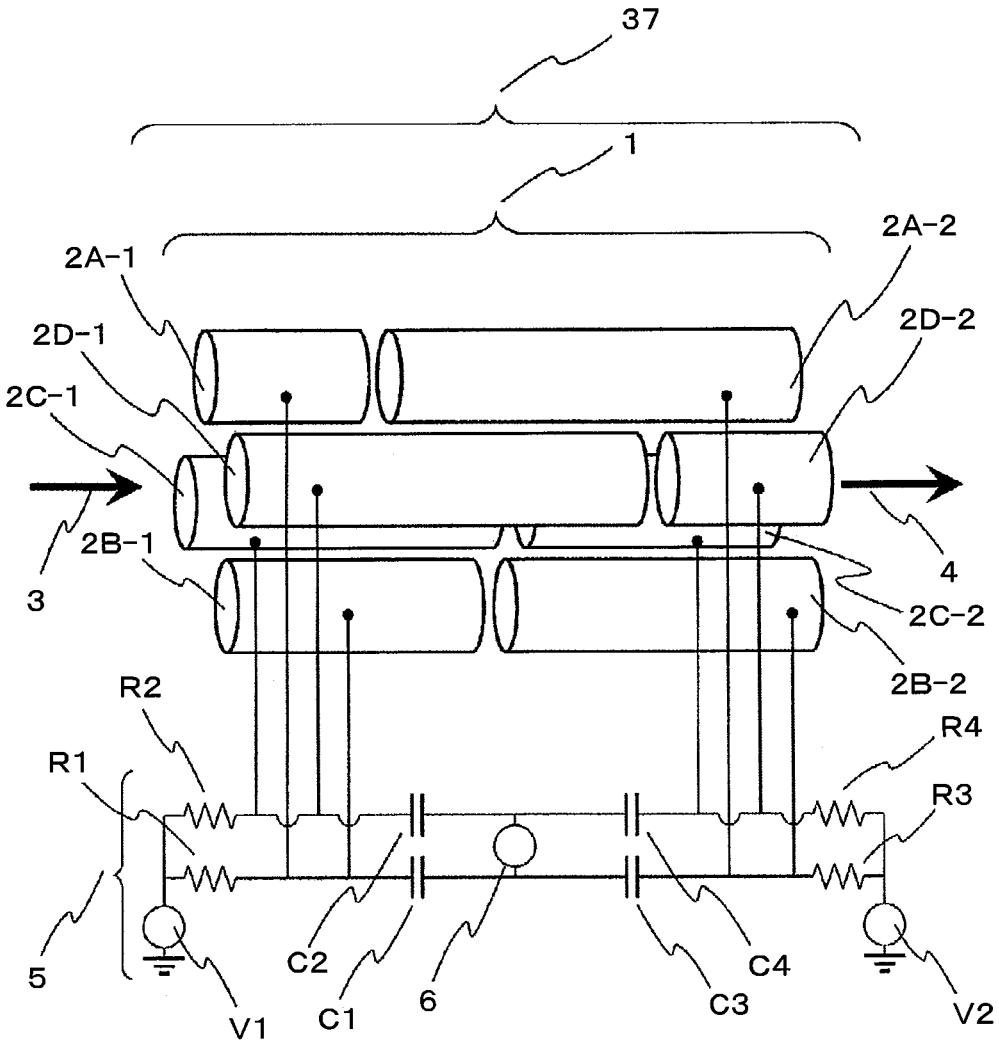
FIG. 1 is a block diagram of a device according to a first embodiment.
Figure 2:
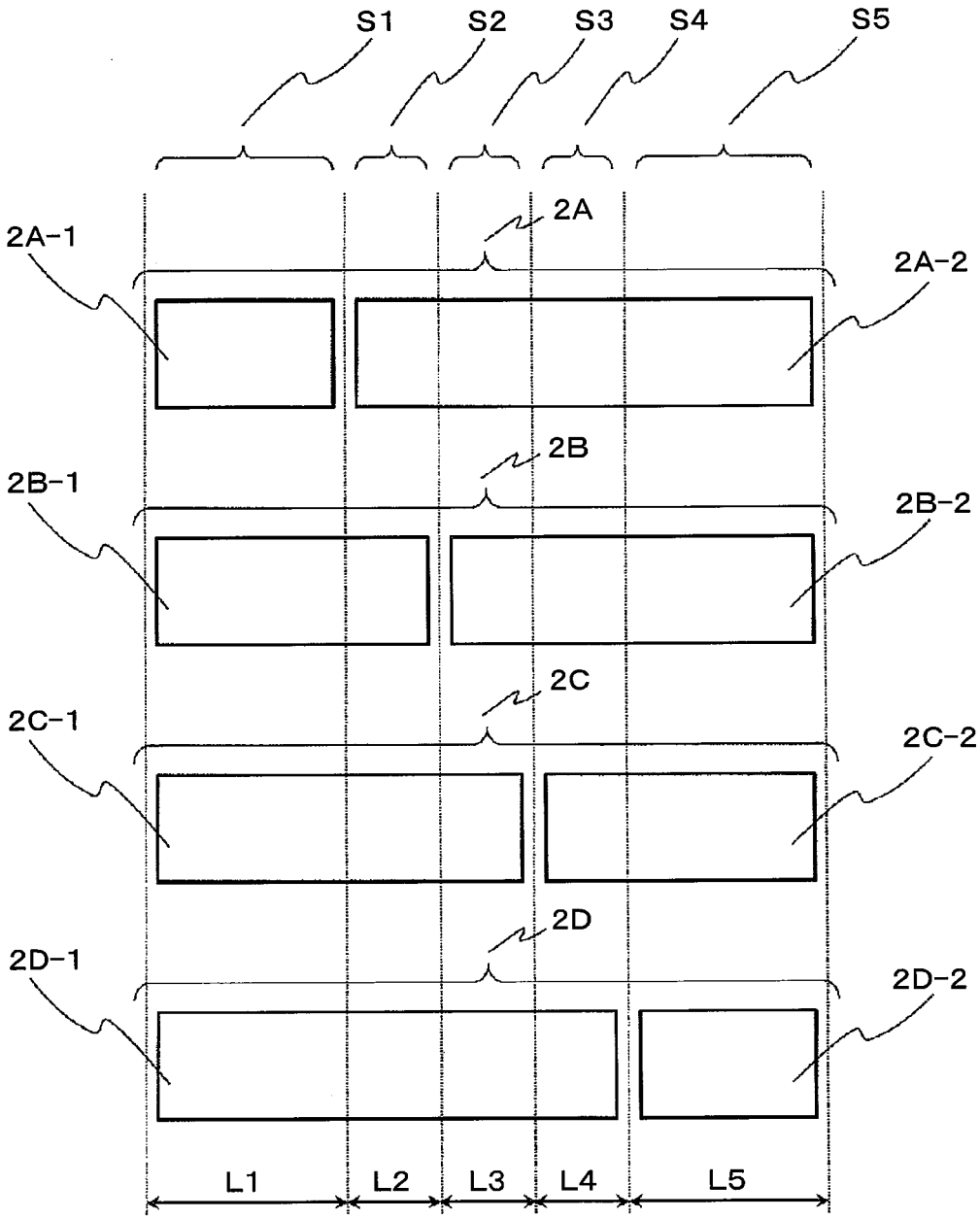
FIG. 2 is an illustration of positions to divide rod electrodes according to the first embodiment.

FIGS. 1 and 2 are illustrations of the configuration of a quadrupole rod electrode using the present method. FIG. 1 is an illustration related to the arrangement of rod electrodes and a method of applying a voltage, and FIG. 2 is an illustration of positions to divide the rod electrodes.

A multipole rod electrode 1 is configured of four rod electrodes 2A to 2D. The four rod electrodes 2A to 2D are divided into segmented rods 2A-1, 2A-2, 2B-1, 2B-2, 2C-1, 2C-2, 2D-1, and 2D-2. In the case where the multipole rod electrode 1 is used as an ion guide 37, ions 3 are introduced from one end of the multipole rod electrode 1 and passed through the multipole rod electrode 1, and ions 4 are ejected from the opposite side.

Next, a method of applying a voltage to the multipole rod electrode 1 using a power supply and circuit 5 will be described. An anti-phase radio-frequency (RF) voltage 6 is applied to the rod electrodes 2A and 2B and the rod electrodes 2C and 2D, and different direct current voltages V1 and V2 are applied to a segmented rod group formed of multipole rods (2A-1, 2B-1, 2C-1, and 2D-1) and a segmented rod group formed of multipole rods (2A-2, 2B-2, 2C-2, and 2D-2), respectively. The radio-frequency (RF) voltage 6 is applied to the segmented rods 2A-1 and 2B-1 through a capacitor C1, and the direct current voltage V1 is applied through a resister R1. The radio-frequency (RF) voltage 6 is applied to the segmented rods 2C-1 and 2D-1 through a capacitor C2, and the direct current voltage V1 is applied through a resister R2. The radio-frequency (RF) voltage 6 is applied to the segmented rods 2A-2 and 2B-2 through a capacitor C3, and the direct current voltage V2 is applied through a resister R3. The radio-frequency (RF) voltage 6 is applied to the segmented rods 2C-2 and 2D-2 through a capacitor C4, and the direct current voltage V2 is applied through a resister R4.

Next, the positions to divide the rod electrodes will be described. As shown in FIG. 2, the four rod electrodes 2A to 2D are divided into two parts at different positions in the axial direction, so that the rod electrodes can be seemingly divided into five segments S1 to S5. As described above, there are included the rod electrodes divided in such a way that the dividing positions are not overlapped with each other in the radial direction, so that regions in different potential states in the axial direction can be formed by the number of regions that are separated at the dividing positions in the axial direction greater than the number of the segmented rods. In other words, as shown in FIG. 1, in the case where the different direct current voltages V1 and V2 are applied to the segmented rods 2A-1, 2B-1, 2C-1, and 2D-1 and the segmented rods 2A-2, 2B-2, 2C-2, and 2D-2, respectively, the average potential of the segments S1 to S5 is $(4\times V1)/4$ in the segment S1, $(3\times V1+V2)/4$ in the segment S2, $(2\times V1+2\times V2)/4$ in the segment S3, $(V1+3\times V2)/4$ in the segment S4, and $(4\times V2)/4$ in the segment S5, and the rod electrodes can be divided into the segments S1 to S5 having five types of different average potentials. The divided segments S1 to S5 at this time can also be expressed by segment lengths L1 to L5.

It is noted that the multipole rod electrode may include rod electrodes divided in such a way that the dividing positions are not overlapped with each other in the radial direction, or the multipole rod electrode may include a rod electrode not divided.

Figure 3A:
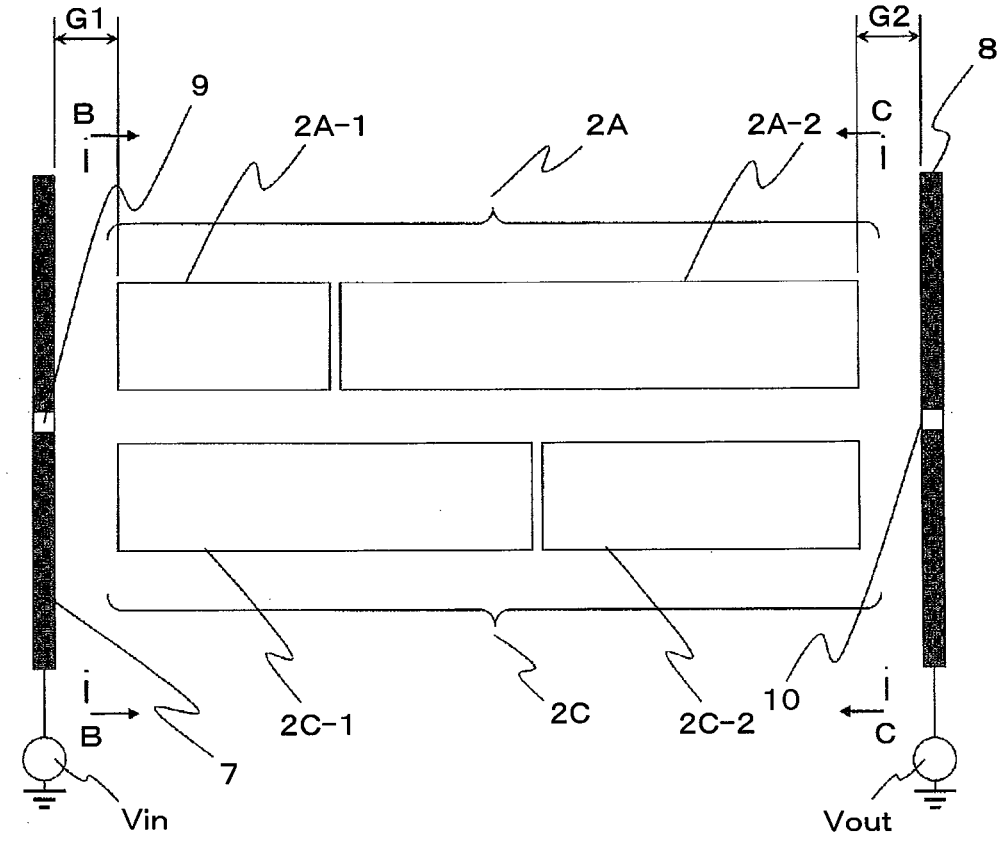
FIG. 3A is an illustration of a simulation model according to the first embodiment.
Figure 3B:
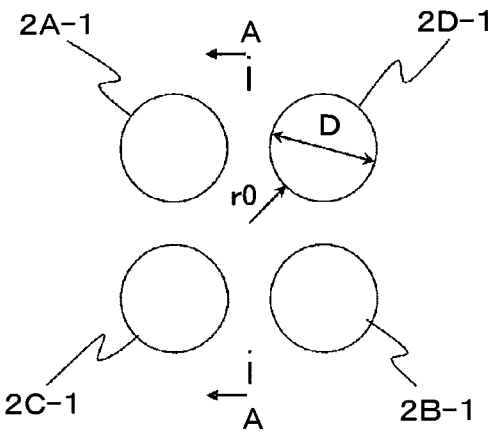
FIG. 3B is an illustration of a simulation model according to the first embodiment.
Figure 3C:
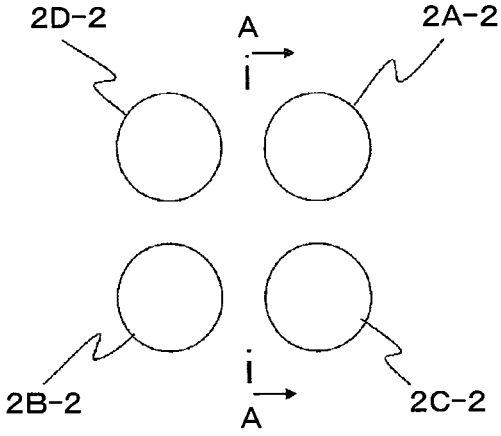
FIG. 3C is an illustration of a simulation model according to the first embodiment.

Next, a model to simulate the central potential or the like of the multipole rod electrode 1 descried in FIGS. 1 and 2 will be described with reference to FIG. 3A-C. The detailed structure of the multipole rod electrode 1 and a method of applying a voltage are the same as in FIGS. 1 and 2. In FIG. 3A-C, a cross sectional view along a line A-A is FIG. 3A, a cross sectional view along a line B-B is FIG. 3B, and a cross sectional view along a line C-C is FIG. 3C.

An inlet electrode 7 is disposed at a position apart from one end of the multipole rod electrode 1 at a gap distance G1, and an outlet electrode 8 is disposed at a position apart from the opposite end at a gap distance G2. The inlet electrode 7 and the outlet electrode 8 include openings 9 and 10, respectively, and direct current voltages Vin and Vout are applied, respectively.

Figure 4:
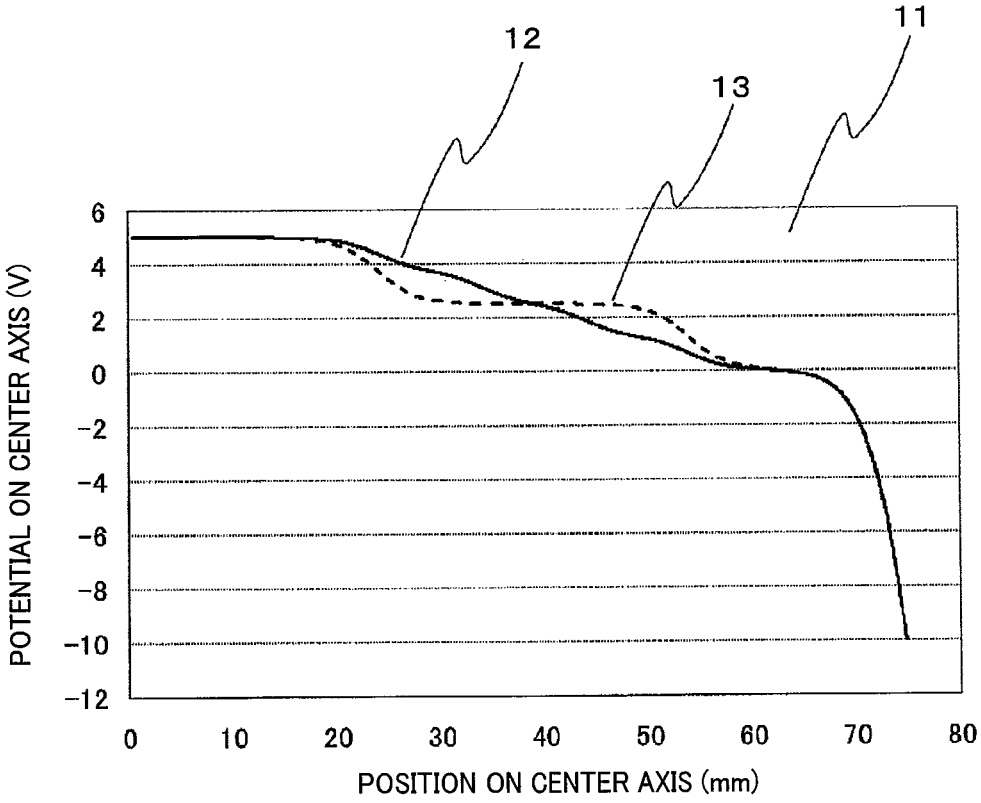
FIG. 4 is an illustration of the simulation result of the central potential according to the first embodiment.

The simulation result of the central potential is shown in FIG. 4 where the direct current voltage V1 applied to the segmented rods 2A-1 to 2D-1 is a voltage of 5 V, the direct current voltage V2 applied to the segmented rods 2A-2 to 2D-2 is a voltage of 0 V, the direct current voltage Vin is a voltage of 5 V, Vout is a voltage of −10 V, the gap distance G1 is 4 mm, and G2 is 2 mm. In a simulation result 11 of the central potential in FIG. 4, a result 12 of the present method is shown in which the four rod electrodes 2A to 2D are divided into two parts at different positions in the axial direction, and a result 13 is shown that all the rod electrodes are divided into three parts at the same position in the axial direction.

The result 12 of the present method is a result where the segment lengths L1, L2, L3, L4, and L5 of the multipole rod electrode 1 are set to 20 mm, 10 mm, 10 mm, 10 mm, and 20 mm, respectively, (70 mm in total), whereas the result 13 that the rod electrodes are divided into three parts is a result where all the rods are divided into three parts in 20 mm, 30 mm, and 20 mm (70 mm in total). It is revealed from the result 12 of the present method in FIG. 4 that the four rod electrodes 2A to 2D are divided at different positions in the axial direction to increase the seeming divided number even by a fewer divided number, so that a continuous, smooth tilted potential can be obtained in the axial direction, without forming a step electric field as in the result 13 that the rod electrodes are divided into three parts. It is noted that a position at 0 mm in the horizontal axis in FIG. 4 is the position of the inlet electrode 7, and a position at 76 mm is the position of the outlet electrode 8. Moreover, a radius r0 of the inscribed circle of the multipole rod electrode 1 is 4.35 mm, and a rod diameter D of the four rod electrodes 2A to 2D is 10 mm.

Figure 5:
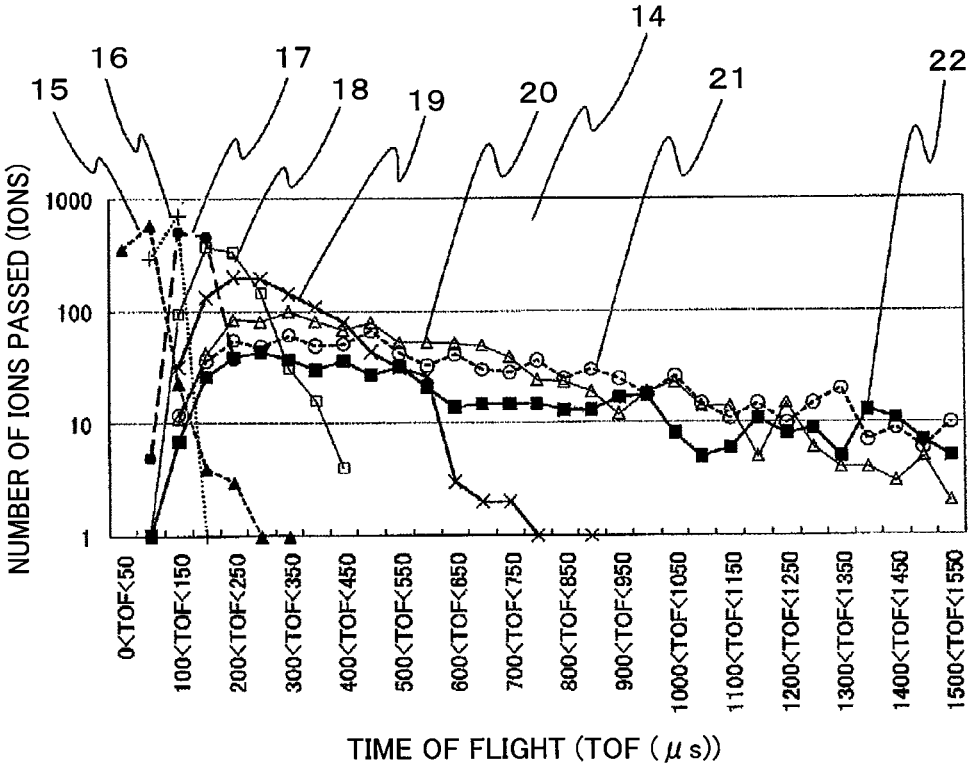
FIG. 5 is an illustration of the simulation result of the ion time of flight according to the first embodiment.

Next, FIG. 5 is results of simulation time for which ions are passed while the ions are colliding against a buffer gas in the atmosphere of the multipole rod electrode 1 using the model shown in FIG. 3A-C. A simulation result 14 of the ion time of flight shown in FIG. 5 shows results 15 to 22 where a potential difference V1−V2 between the direct current voltage V1 applied to the segmented rods 2A-1 to 2D-1 and the direct current voltage V2 applied to the segmented rods 2A-2 to 2D-2 is voltages of 10 V, 5 V, 2 V, 1 V, 0.5 V, 0.2 V, 0.1 V, and 0 V, respectively. The horizontal axis in FIG. 5 expresses the time of flight (TOF), and the vertical axis expresses the number of ions passed and counted in the range of the TOF expressed on the horizontal axis. From FIG. 5, the time constant of ions being passed is within 100 μs under the conditions at a potential difference of 0.5 V or more, and ions can be passed through the multipole rod electrode 1 for a short time. It is noted that the following is the conditions of simulation. The mass-to-charge ratio (m/z) of ions is 600 (positive ions), the collision cross-section is 2.8 e-18 $m^2$, the number of ions is 1,000, the buffer gas is nitrogen at 10 mTorr (1.3 Pa), and ion incident energy is 10 eV.

Figure 6:
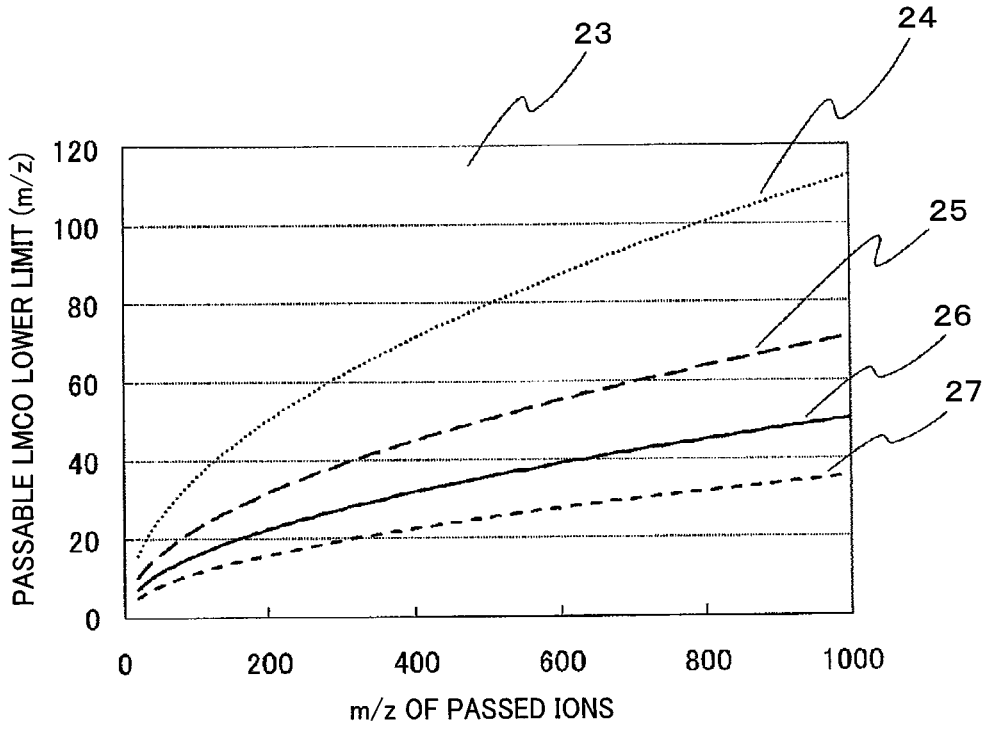
FIG. 6 is an illustration of the simulation result of an LMCO lower limit according to the first embodiment.

Next, FIG. 6 is results that the lower limit of low-mass cutoff (LMCO) at time to pass ions was determined with respect to the m/z of ions passable in the multipole rod electrode 1 by simulation using the model shown in FIG. 3A-C. A simulation result 23 of the LMCO lower limit shown in FIG. 6 shows results 24 to 27 where a potential difference V1−V2 between the direct current voltage V1 applied to the segmented rods 2A-1 to 2D-1 and the direct current voltage V2 applied to the segmented rods 2A-2 to 2D-2 is voltages of 5 V, 2 V, 1 V, and 0.5 V.

The LMCO lower limit is the lower limit of the passable m/z under the conditions, and it can be said that the range (the mass window) of the passable m/z is wider as the m/z of the LMCO lower limit is smaller with respect to the m/z of ions being passed. Particularly, in the case where the ion guide 37 configured of the multipole rod electrode 1 is used as an ion dissociation unit, ions being passed collide against a buffer gas, and fragment ions are generated, so that a wide mass window is demanded on the low mass side particularly.

In the present method, since the segmented rods applied with different direct current voltage V1 or V2 are mixed in the segments S2 to S4 shown in FIGS. 1 and 2, a potential gradient occurs in the radial direction. Under the conditions that the LMCO is low, it is highly likely that ions are removed in the radial direction due to the potential gradient in the radial direction caused by the potential difference between the segmented rods because pseudopotential in the multipole rod electrode is decreased. However, from FIG. 6, when a potential difference is a voltage of about 1 V, the LMCO lower limit is a m/z of about 30 with respect to ions being passed at a m/z of 400, for example, and a mass window ten times or more can be secured, so that it is revealed that the present method practically has no problem.

Moreover, as shown in FIGS. 1 and 2, the shortest segmented rod 2A-1 and the second shortest segmented rod 2B-1 when seen from one end (on the left side in the drawings, for example) are disposed at the opposite positions to each other, so that the influence of the potential gradient in the radial direction can be suppressed at the minimum. In detail, in the region of the segment S1, the same direct current voltage V1 is applied to all the segmented rods 2A-1 to 2D-1, so that the potential gradient in the radial direction does not occur because the segmented rods 2A-1 to 2D-1 are symmetrical in the radial direction. In the region of the segment S2, the direct current voltage V1 is applied to the segmented rods 2B-1 to 2D-1, and the direct current voltage V2 is applied to the segmented rod 2A-2, so that the potential gradient in the radial direction occurs because the segmented rods 2B-1 to 2D-1 and the segmented rod 2A-2 are not symmetrical in the radial direction. In the region of the segment S3, the direct current voltage V1 is applied to the segmented rods 2C-1 to 2D-1, and the direct current voltage V2 is applied to the segmented rods 2A-2 to 2B-2, so that the potential gradient in the radial direction rarely occurs near the center axis of the multipole rod electrode 1 because the same direct current voltage is applied to the segmented rods at the opposite positions to each other. In other words, when ions are passed from the segment S1 to the segment S3, the segmented rod 2B-1 next shortest to the segmented rod 2A-1 is disposed at the opposite position, so that ions can be converged on near the center axis because of the segment S3 even though the trajectory becomes unstable due to the potential gradient in the radial direction in the segment S2. On the contrary, when the length of the segmented rod 2C-1 or 2D-1 is set to the length next shortest to the segmented rod 2A-1, the potential gradient in the radial direction occurs on the center axis also in the segment S3, and the region that is continuously affected by the potential gradient is prolonged. Therefore, the unstable state of the ion trajectory is also continued, so that ions are sometimes removed in the radial direction because of the influence of the radio-frequency (RF) voltage 6.

In the present method, the case is described where ions are positive ions and the relationship between the direct current voltage V1 applied to the segmented rods 2A-1 to 2D-1 and the direct current voltage V2 applied to the segmented rods 2A-2 to 2D-2 is V1>V2. However, the condition V1<V2 is established, so that the potential of the gradient opposite to the potential of the gradient in FIG. 4 can be obtained (the potential is high in the direction of the outlet electrode 8), and the conditions effective to accelerate negative ions can also be established. The magnitude of the direct current voltage may be set in such a way that the absolute value of a value of a voltage applied to the segmented rod group on the ion introducing side is greater than the absolute value of a value of a voltage applied to the segmented rod group on the ion ejecting side.

In the present method, as described above, it is unnecessary to provide direct current power supplies by the number of regions in different potential states in order to form the regions in different potential states in the axial direction. When there are direct current power supplies by the number of divided segmented rod groups, regions in different potential states more than the number of segmented rod groups can be formed according to the positions to divide the rods. Accordingly, it is possible to shorten the ion time of flight with a configuration of simple power supplies and wiring, and it is possible to perform analysis at high throughput.

As described above, in the first embodiment, the principle and the effect have been described in the configuration in which in a quadrupole rod electrode that a multipole rod electrode configuring an ion guide is formed of four rod electrodes, all the rod electrodes are divided into two parts at different positions in the axial direction.

Second Embodiment

In a second embodiment, a configuration will be described in which in a quadrupole rod electrode that a multipole rod electrode configuring an ion guide is formed of four rod electrodes, all the rod electrodes are divided into three parts at different positions in the axial direction.

Figure 7:
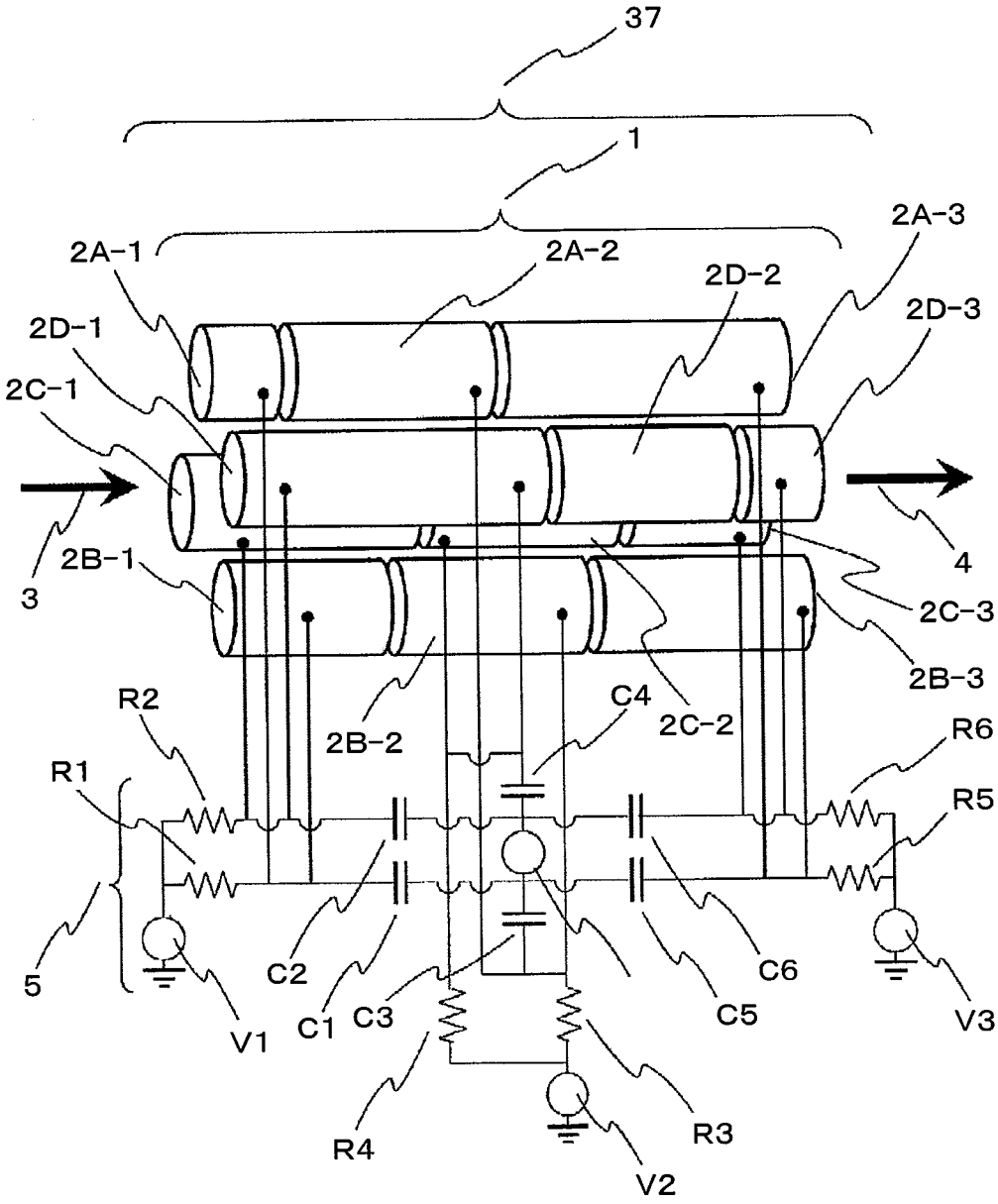
FIG. 7 is a block diagram of a device according to a second embodiment.
Figure 8:
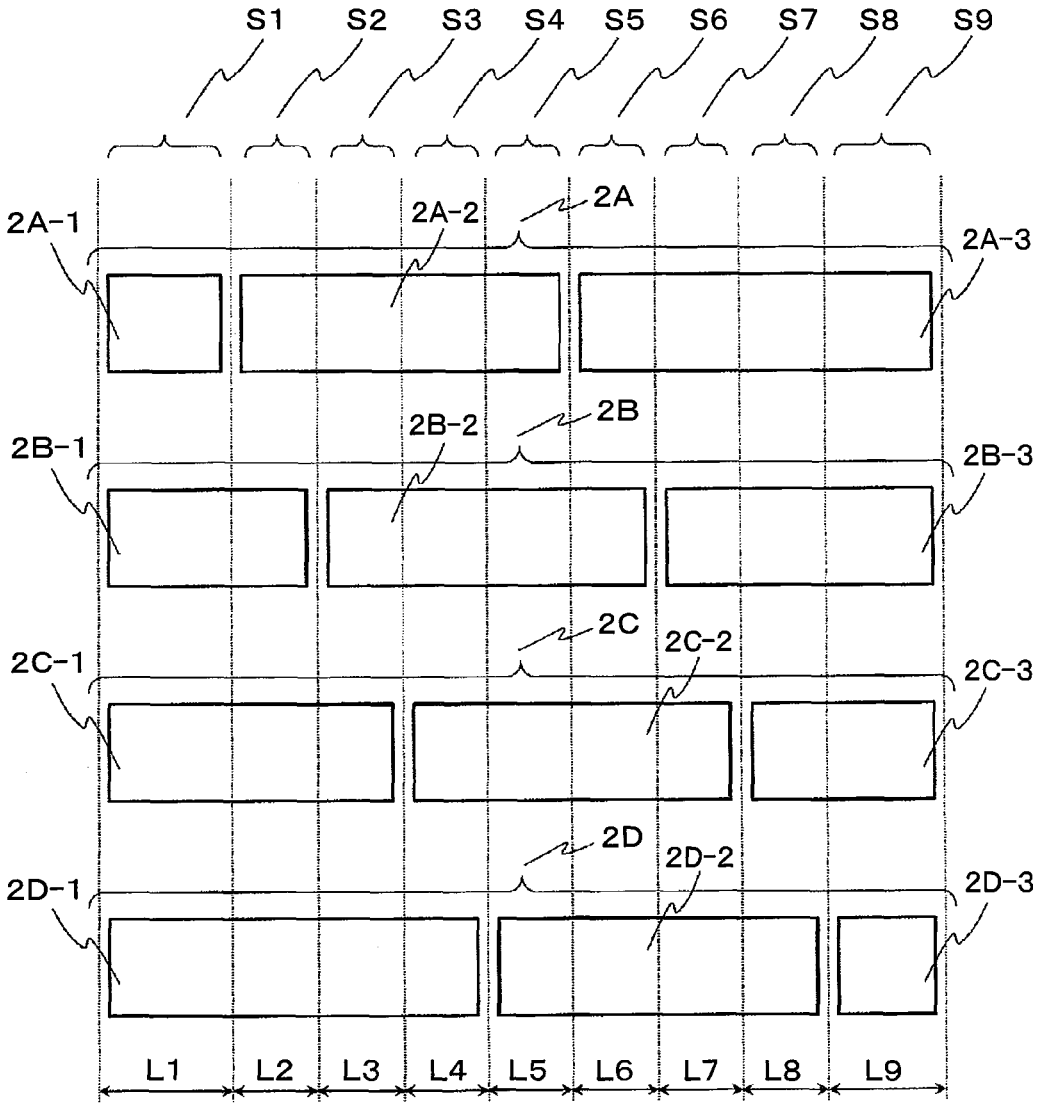
FIG. 8 is an illustration of positions to divide rod electrodes according to the second embodiment.

FIGS. 7 and 8 are illustrations of the configuration of a quadrupole rod electrode using the present method.

FIG. 7 is an illustration related to the arrangement of rod electrodes and a method of applying a voltage, and FIG. 8 is an illustration of positions to divide the rod electrodes.

A multipole rod electrode 1 is configured of four rod electrodes 2A to 2D. The four rod electrodes 2A to 2D are divided into segmented rods 2A-1, 2A-2, 2A-3, 2B-1, 2B-2, 2B-3, 2C-1, 2C-2, 2C-3, 2D-1, 2D-2, and 2D-3. In the case where the multipole rod electrode 1 is used as an ion guide 37, ions 3 are introduced from one end of the multipole rod electrode 1 and passed through the multipole rod electrode 1, and ions 4 are ejected from the opposite side.

Next, a method of applying a voltage to the multipole rod electrode 1 using a power supply and circuit 5 will be described. An anti-phase radio-frequency (RF) voltage 6 is applied to the rod electrodes 2A and 2B and the rod electrodes 2C and 2D, and different direct current voltages V1, V2, and V3 are applied to the segmented rods 2A-1, 2B-1, 2C-1, and 2D-1, the segmented rods 2A-2, 2B-2, 2C-2, and 2D-2, and the segmented rod 2A-3, 2B-3, 2C-3, and 2D-3, respectively. The radio-frequency (RF) voltage 6 is applied to the segmented rods 2A-1 and 2B-1 through a capacitor C1, and the direct current voltage V1 is applied through a resister R1. The radio-frequency (RF) voltage 6 is applied to the segmented rods 2C-1 and 2D-1 through a capacitor C2, and the direct current voltage V1 is applied through a resister R2. The radio-frequency (RF) voltage 6 is applied to the segmented rods 2A-2 and 2B-2 through a capacitor C3, and the direct current voltage V2 is applied through a resister R3. The radio-frequency (RF) voltage 6 is applied to the segmented rods 2C-2 and 2D-2 through a capacitor C4, and the direct current voltage V2 is applied through a resister R4. The radio-frequency (RF) voltage 6 is applied to the segmented rod 2A-3 and 2B-3 through a capacitor C5, and the direct current voltage V3 is applied through a resistance R5. The radio-frequency (RF) voltage 6 is applied to the segmented rod 2C-3 and 2D-3 through a capacitor C6, and the direct current voltage V3 is applied through a resistance R6.

Next, the positions to divide the rod electrodes will be described. As shown in FIG. 8, the four rod electrodes 2A to 2D are divided into three parts at different positions in the axial direction, so that the rod electrodes can be seemingly divided into nine segments S1 to S9. In other words, as similar to the first embodiment, the rod electrodes can be divided into the segments S1 to S9 having nine types of different average potentials. The divided segments S1 to S9 at this time can also be expressed by segment lengths L1 to L9.

Also in the second embodiment, the effect similar to the effect in the first embodiment can be obtained. However, a more continuous, smooth tilted potential in the axial direction can be obtained because the number of the rod electrodes divided is greater than that in the first embodiment.

Moreover, as shown in FIGS. 7 and 8, the shortest segmented rod 2A-1 and the second shortest segmented rod 2B-1 when seen from one end (on the left side in the drawings, for example) are disposed at the opposite positions to each other, so that the influence of the potential gradient in the radial direction can be suppressed at the minimum.

As described above, in the second embodiment, the principle and the effect have been described in the configuration in which in a quadrupole rod electrode that a multipole rod electrode configuring an ion guide is formed of four rod electrodes, all the rod electrodes are divided into three parts at different positions in the axial direction.

Third Embodiment

In a third embodiment, a configuration will be described in which in a quadrupole rod electrode that a multipole rod electrode configuring an ion guide is formed of four rod electrodes, pairs of two rod electrodes at the opposite positions to each other are divided into three parts at the same position in the axial direction and different pairs are divided into three parts at different positions in the axial direction.

Figure 9:
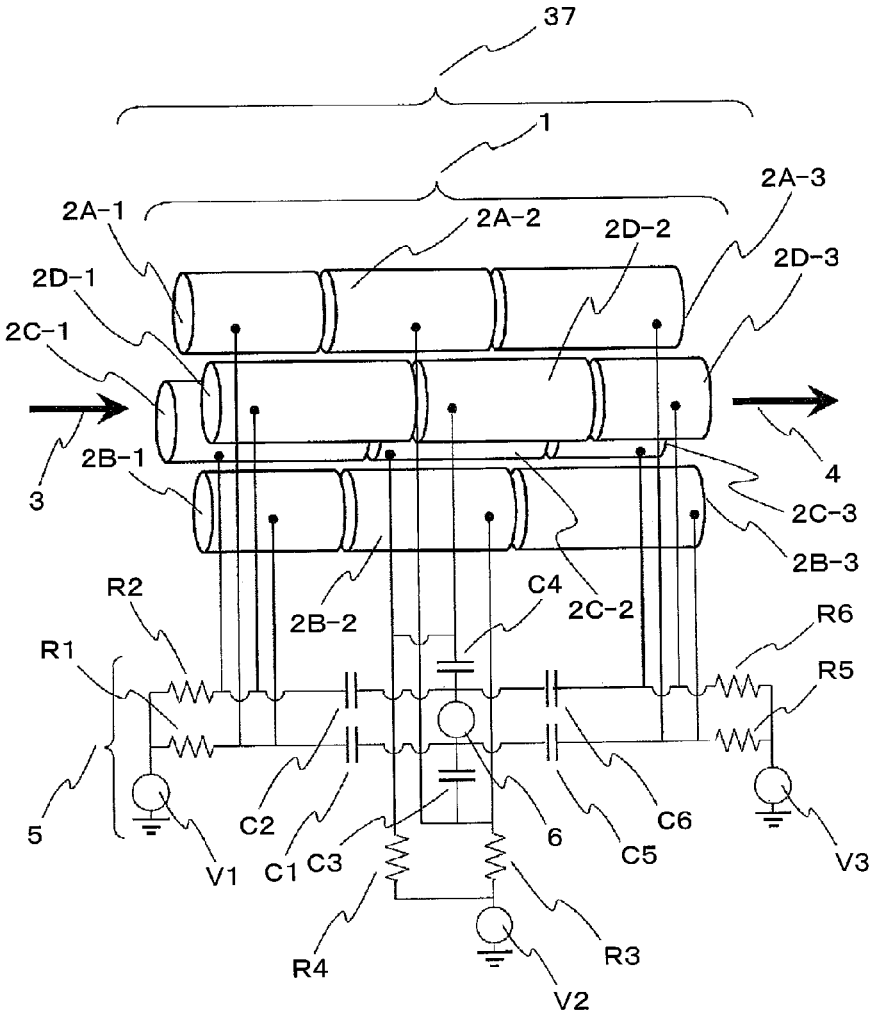
FIG. 9 is a block diagram of a device according to a third embodiment.
Figure 10:
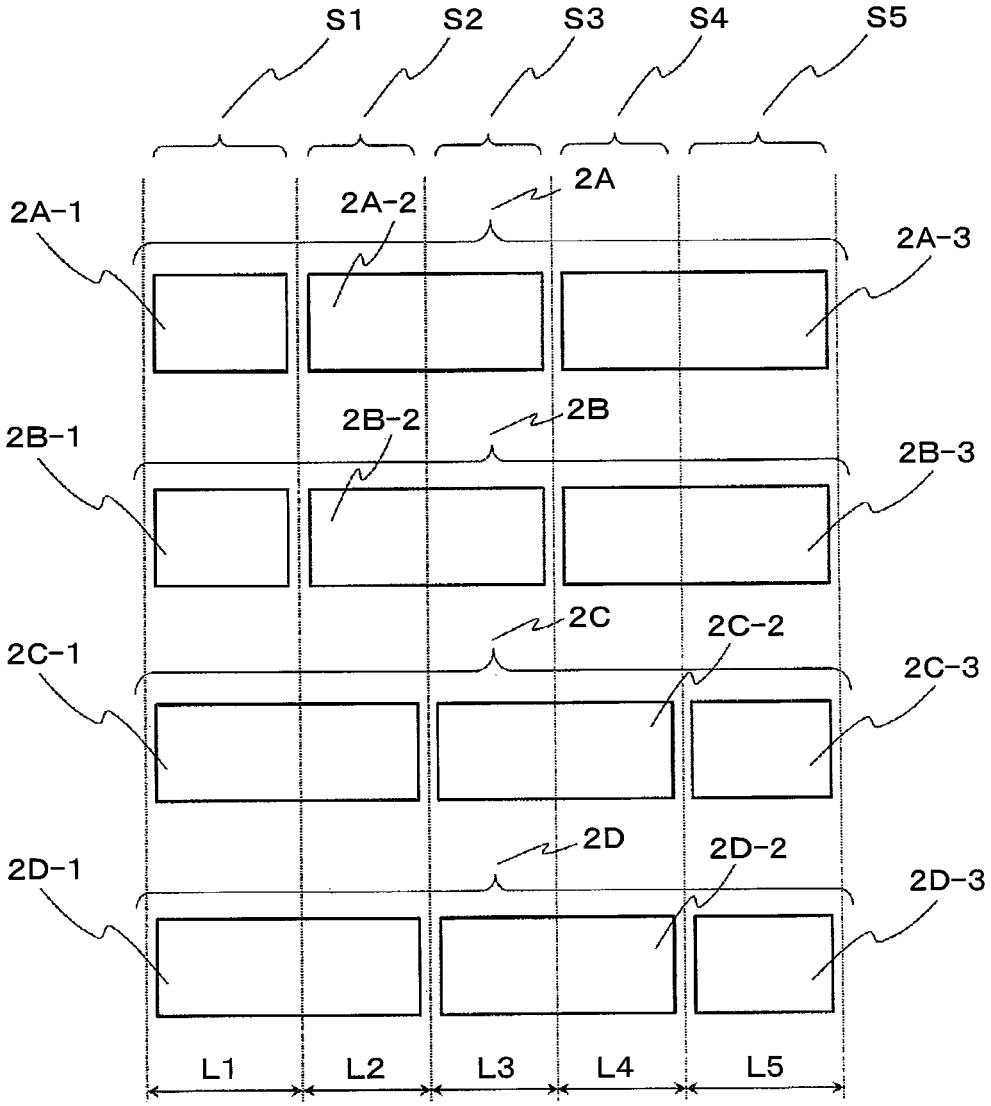
FIG. 10 is an illustration of positions to divide rod electrodes according to the third embodiment.

FIGS. 9 and 10 are illustrations of the configuration of a quadrupole rod electrode using the present method. FIG. 9 is an illustration related to the arrangement of rod electrodes and a method of applying a voltage, and FIG. 10 is an illustration of positions to divide the rod electrodes.

A multipole rod electrode 1 is configured of four rod electrodes 2A to 2D. The four rod electrodes 2A to 2D are divided into segmented rods 2A-1, 2A-2, 2A-3, 2B-1, 2B-2, 2B-3, 2C-1, 2C-2, 2C-3, 2D-1, 2D-2, and 2D-3. In the case where the multipole rod electrode 1 is used as an ion guide 37, ions 3 are introduced from one end of the multipole rod electrode 1 and passed through the multipole rod electrode 1, and ions 4 are ejected from the opposite side.

Next, a method of applying a voltage to the multipole rod electrode 1 using a power supply and circuit 5 will be described. An anti-phase radio-frequency (RF) voltage 6 is applied to the rod electrodes 2A and 2B and the rod electrodes 2C and 2D, and different direct current voltages V1, V2, and V3 are applied to the segmented rods 2A-1, 2B-1, 2C-1, and 2D-1, the segmented rods 2A-2, 2B-2, 2C-2, and 2D-2, and the segmented rod 2A-3, 2B-3, 2C-3, and 2D-3, respectively. The radio-frequency (RF) voltage 6 is applied to the segmented rods 2A-1 and 2B-1 through a capacitor C1, and the direct current voltage V1 is applied through a resister R1. The radio-frequency (RF) voltage 6 is applied to the segmented rods 2C-1 and 2D-1 through a capacitor C2, and the direct current voltage V1 is applied through a resister R2. The radio-frequency (RF) voltage 6 is applied to the segmented rods 2A-2 and 2B-2 through a capacitor C3, and the direct current voltage V2 is applied through a resister R3. The radio-frequency (RF) voltage 6 is applied to the segmented rods 2C-2 and 2D-2 through a capacitor C4, and the direct current voltage V2 is applied through a resister R4. The radio-frequency (RF) voltage 6 is applied to the segmented rod 2A-3 and 2B-3 through a capacitor C5, and the direct current voltage V3 is applied through a resistance R5. The radio-frequency (RF) voltage 6 is applied to the segmented rod 2C-3 and 2D-3 through a capacitor C6, and the direct current voltage V3 is applied through a resistance R6.

Next, the positions to divide the rod electrodes will be described. As shown in FIG. 10, among the four rod electrodes 2A to 2D, two rod electrodes 2A and 2B and two rod electrodes 2C and 2D at the opposite positions to each other are divided into three parts at the same position in the axial direction, and different pairs of the rod electrodes are divided into three parts at different positions in the axial direction, so that the rod electrodes can be seemingly divided into five segments S1 to S5. In other words, as similar to the first embodiment, the rod electrodes can be divided into the segments S1 to S5 having five types of different average potentials. The divided segments S1 to S5 at this time can also be expressed by segment lengths L1 to L5.

Also in the third embodiment, the effect similar to the effect in the first embodiment or the second embodiment can be obtained. However, although the continuous state of the tilted potential in the axial direction is inferior because the seeming divided number is smaller than that in the second embodiment using the same rod electrodes divided into three parts, the same direct current voltage is applied to the segmented rods at the opposite positions to each other in all the regions in the segments S1 to S5 because the positions to divide the rod electrodes at the opposite positions to each other are matched in the axial direction. Accordingly, the influence of the potential gradient in the radial direction near the center axis of the multipole rod electrode 1 can be reduced in all the regions.

As described above, in the third embodiment, the principle and the effect have been described in the configuration in which in a quadrupole rod electrode that a multipole rod electrode configuring an ion guide is formed of four rod electrodes, pairs of two rod electrodes at the opposite positions to each other are divided into three parts at the same position in the axial direction and different pairs are divided into three parts at different positions in the axial direction.

Fourth Embodiment

In a fourth embodiment, a configuration will be described in which in a hexapole rod electrode that a multipole rod electrode configuring an ion guide is formed of six rod electrodes, all the rod electrodes are divided into two parts at different positions in the axial direction.

Figure 11:
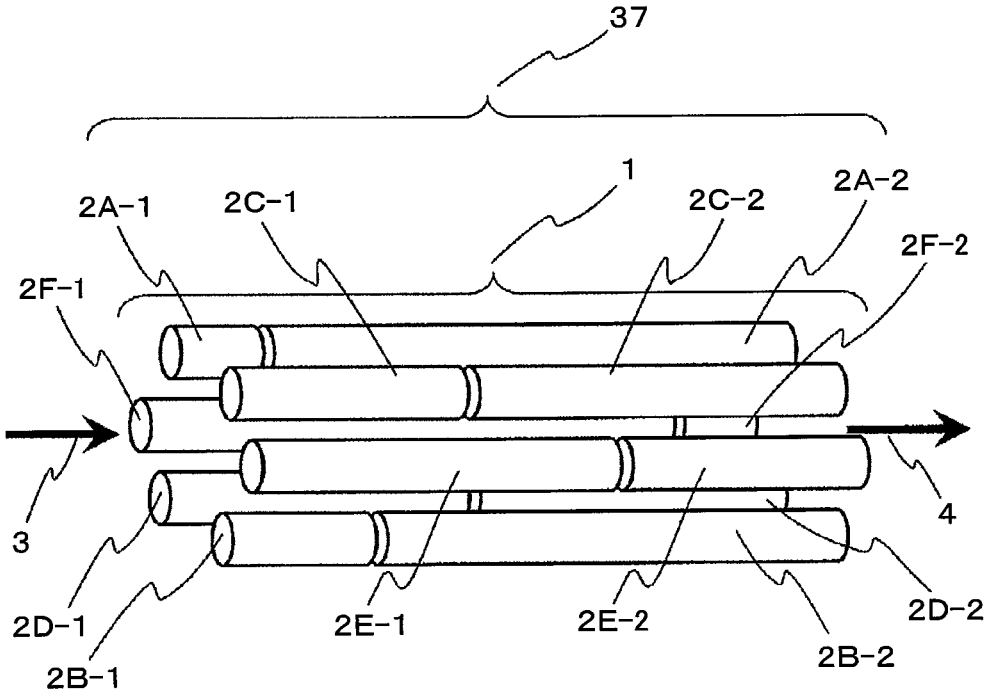
FIG. 11 is a block diagram of a device according to a fourth embodiment.
Figure 12:
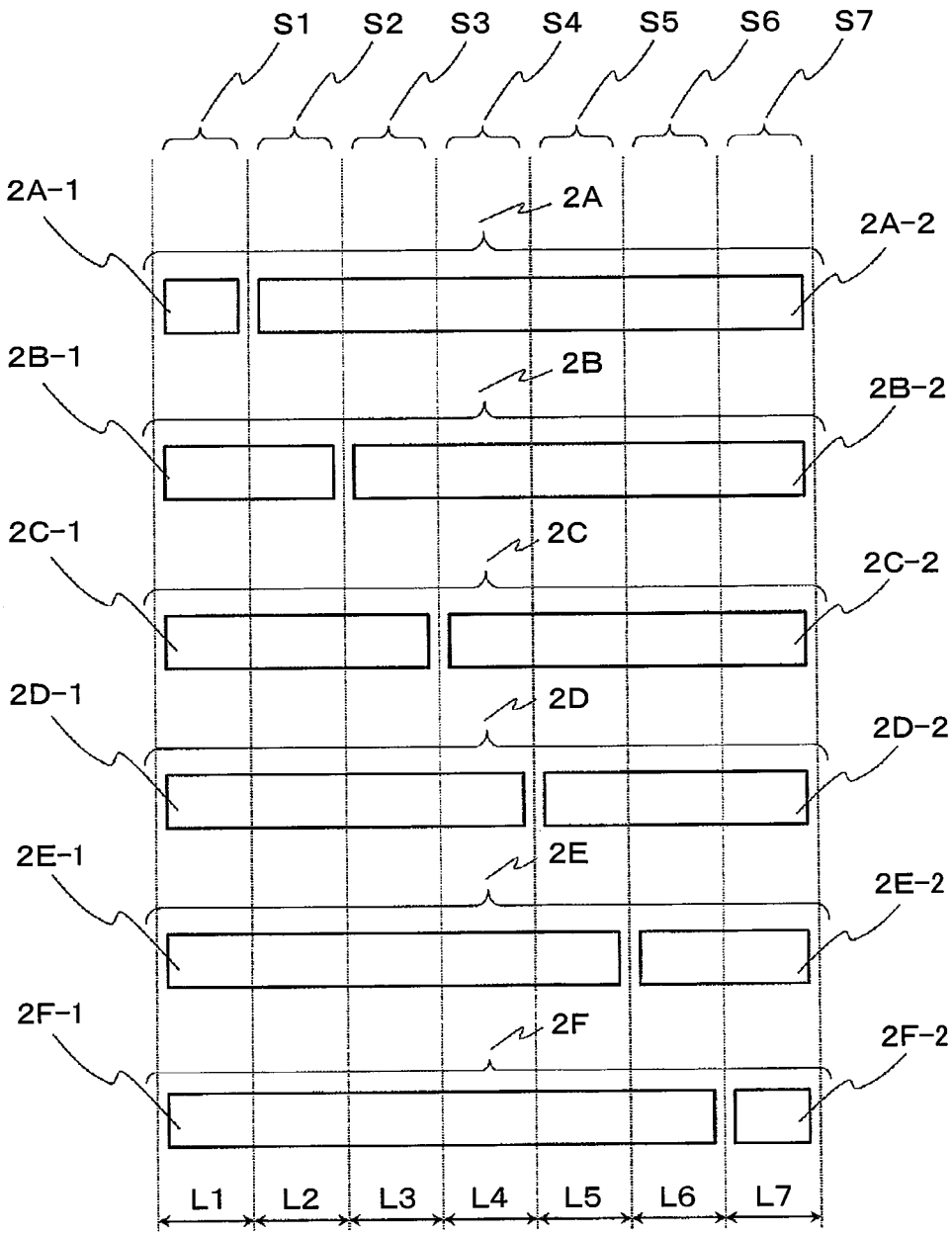
FIG. 12 is an illustration of positions to divide rod electrodes according to the fourth embodiment.

FIGS. 11 and 12 are illustrations of the configuration of a hexapole rod electrode using the present method. FIG. 11 is an illustration related to the arrangement of rod electrodes, and FIG. 12 is an illustration of positions to divide the rod electrodes.

A multipole rod electrode 1 is configured of six rod electrodes 2A to 2F. The six rod electrodes 2A to 2F are divided into segmented rods 2A-1, 2A-2, 2B-1, 2B-2, 2C-1, 2C-2, 2D-1, 2D-2, 2E-1, 2E-2, 2F-1, and 2F-2. In the case where the multipole rod electrode 1 is used as an ion guide 37, ions 3 are introduced from one end of the multipole rod electrode 1 and passed through the multipole rod electrode 1, and ions 4 are ejected from the opposite side.

The detailed description of a method of applying a voltage to the multipole rod electrode 1 using a power supply and circuit 5 is omitted in the drawings. However, the method is almost similar to the method in the first embodiment. An anti-phase radio-frequency (RF) voltage 6 is applied to the rod electrodes 2A, 2D, and 2E and the rod electrodes 2B, 2C, and 2F, and different direct current voltages V1 and V2 are applied to the segmented rods 2A-1, 2B-1, 2C-1, 2D-1, 2E-1, and 2F-1 and the segmented rods 2A-2, 2B-2, 2C-2, 2D-2, 2E-2, and 2F-2.

Next, the positions to divide the rod electrodes will be described. As shown in FIG. 12, the six rod electrodes 2A to 2F are divided into two parts at different positions in the axial direction, so that the rod electrodes can be seemingly divided into seven segments S1 to S7. In other words, the rod electrodes can be divided into the segments S1 to S7 having seven types of different average potentials. The divided segments S1 to S7 at this time can also be expressed by segment lengths L1 to L7.

Also in the embodiment, the effect similar to the effect in the first embodiment can be obtained. However, the seeming divided number is increased because the number of the rod electrodes is greater even though the rod electrodes are divided into two parts the same as in the first embodiment, and thus a more continuous, smooth tilted potential in the axial direction can be obtained.

Moreover, the mass window of the hexapole multipole rod electrode is generally wider than the mass window of the quadrupole multipole rod, so that a mass window wider than the mass window of the quadrupole multipole rod can be secured even in the case where there is the influence of the potential gradient in the radial direction.

Furthermore, as shown in FIGS. 11 and 12, the shortest segmented rod 2A-1 and the second shortest segmented rod 2B-1 are disposed at the opposite positions to each other when seen from one end (on the left side in the drawings, for example), the third shortest segmented rod 2C-1 and the fourth shortest segmented rod 2D-1 are disposed at the opposite positions to each other, and the fifth shortest segmented rod 2E-1 and the sixth shortest segmented rod 2F-1 are disposed at the opposite positions to each other, so that the influence of the potential gradient in the radial direction can be suppressed at the minimum. In other words, it is important that the next shortest segmented rod to the odd-numbered segmented rod is disposed at the position opposite to the odd-numbered segmented rod when seen from one end.

As described above, in the fourth embodiment, the principle and the effect have been described in the configuration in which in a hexapole rod electrode that a multipole rod electrode configuring an ion guide is formed of six rod electrodes, all the rod electrodes are divided into two parts at different positions in the axial direction.

Fifth Embodiment

In the fifth embodiment, a configuration will be described in which in an octopole rod electrode that a multipole rod electrode configuring an ion guide is formed of eight rod electrodes, all the rod electrodes are divided into two parts at different positions in the axial direction.

Figure 13:
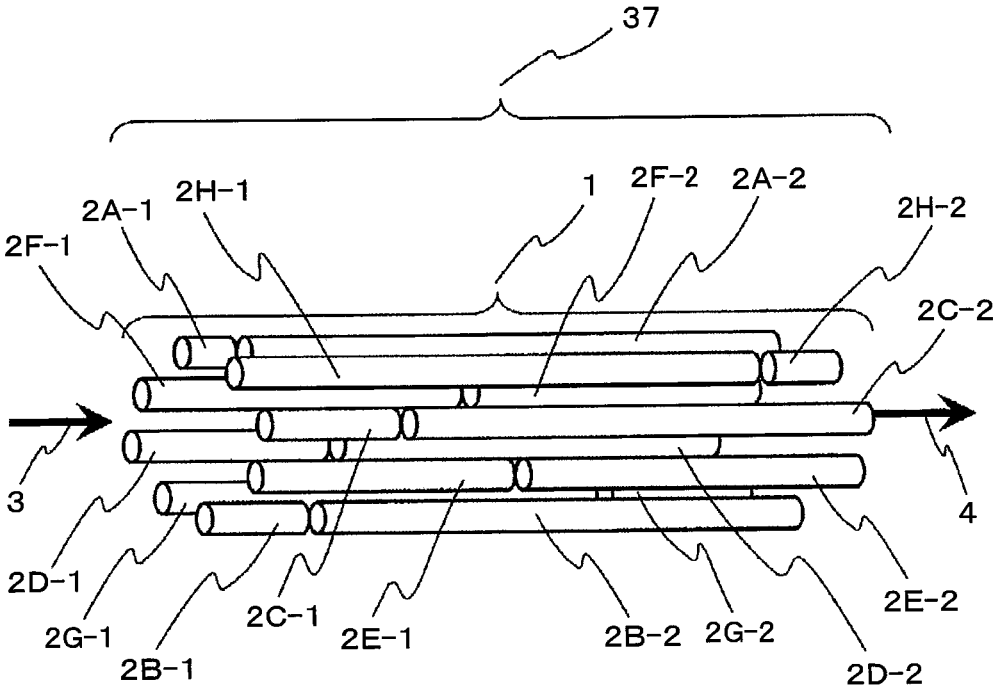
FIG. 13 is a block diagram of a device according to a fifth embodiment.
Figure 14:
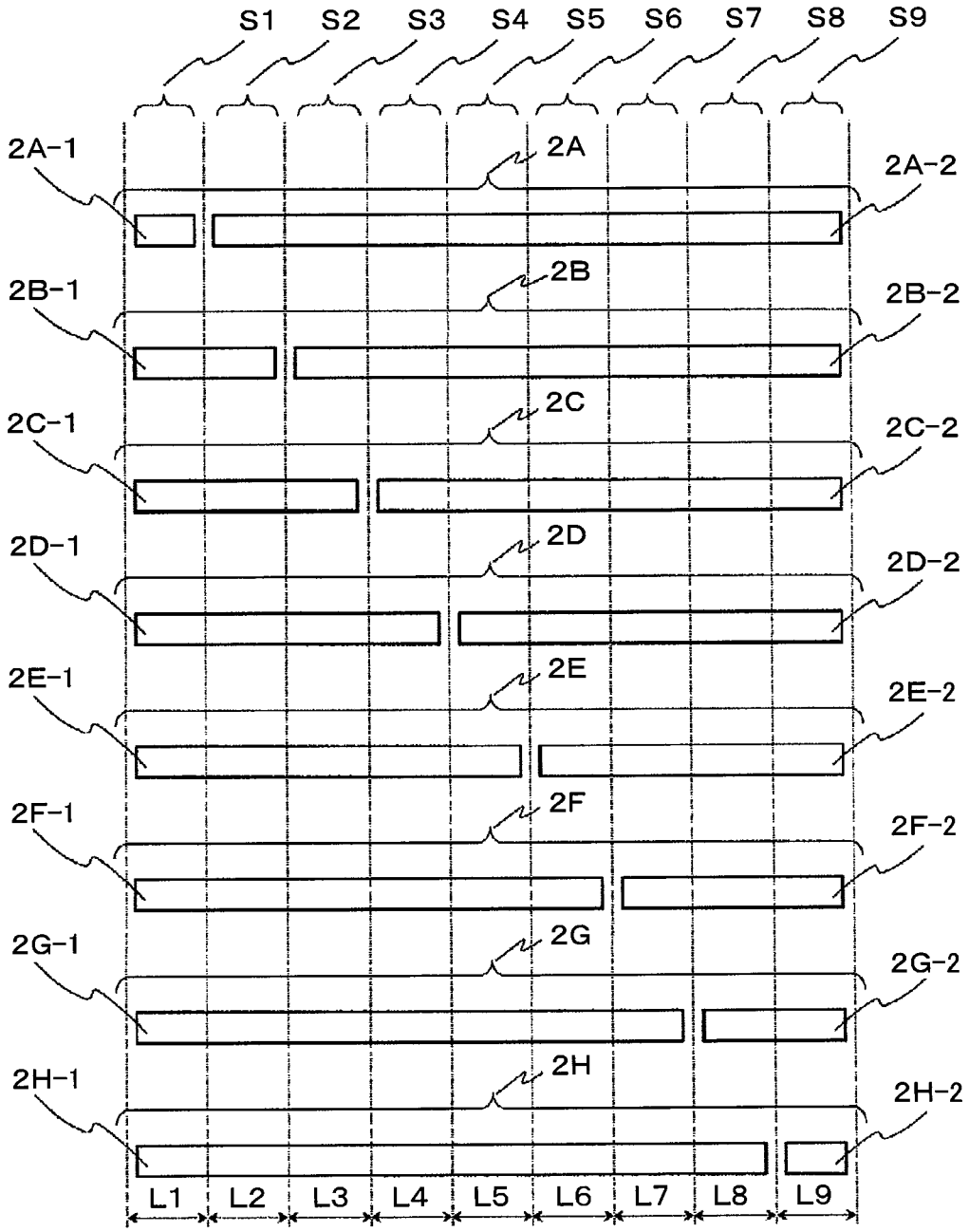
FIG. 14 is an illustration of positions to divide rod electrodes according to the fifth embodiment.

FIGS. 13 and 14 are illustrations of the configuration of an octopole rod electrode using the present method. FIG. 13 is an illustration related to the arrangement of rod electrodes, and FIG. 14 is an illustration of positions to divide the rod electrodes.

A multipole rod electrode 1 is configured of eight rod electrodes 2A to 2H. The eight rod electrodes 2A to 2H are divided into segmented rods 2A-1, 2A-2, 2B-1, 2B-2, 2C-1, 2C-2, 2D-1, 2D-2, 2E-1, 2E-2, 2F-1, 2F-2, 2G-1, 2G-2, 2H-1, and 2H-2. In the case where the multipole rod electrode 1 is used as an ion guide 37, ions 3 are introduced from one end of the multipole rod electrode 1 and passed through the multipole rod electrode 1, and ions 4 are ejected from the opposite side.

The detailed description of a method of applying a voltage to the multipole rod electrode 1 using a power supply and circuit 5 is omitted in the drawings. However, the method is almost similar to the method in the first embodiment. An anti-phase radio-frequency (RF) voltage 6 is applied to the rod electrodes 2A, 2B, 2C, and 2D and the rod electrodes 2E, 2F, 2G, and 2H, and different direct current voltages V1 and V2 are applied to the segmented rods 2A-1, 2B-1, 2C-1, 2D-1, 2E-1, 2F-1, 2G-1, and 2H-1 and the segmented rods 2A-2, 2B-2, 2C-2, 2D-2, 2E-2, 2F-2, 2G-2, and 2H-2, respectively.

Next, the positions to divide the rod electrodes will be described. As shown in FIG. 14, the eight rod electrodes 2A to 2H are divided into two parts at different positions in the axial direction, so that the rod electrodes can be seemingly divided into nine segments S1 to S9. In other words, the rod electrodes can be divided into the segments S1 to S9 having nine types of different average potentials. The divided segments S1 to S9 at this time can also be expressed by segment lengths L1 to L9.

Also in the embodiment, the effect similar to the effect in the first embodiment and the fourth embodiment can be obtained. However, the seeming divided number is increased because the number of the rod electrodes is greater even though the rod electrodes are divided into two parts the same as in the first embodiment and the fourth embodiment, and thus a more continuous, smooth tilted potential in the axial direction can be obtained.

Moreover, the mass window of the octopole multipole rod electrode is generally wider than the mass window of the quadrupole rod electrode or the hexapole rod electrode, so that a mass window wider than the mass window of the quadrupole rod electrode or the hexapole rod electrode can be secured even in the case where there is the influence of the potential gradient in the radial direction.

Moreover, as shown in FIGS. 13 and 14, the shortest segmented rod 2A-1 and the second shortest segmented rod 2B-1 are disposed at the opposite positions to each other when seen from one end (on the left side in the drawings, for example), the third shortest segmented rod 2C-1 and the fourth shortest segmented rod 2D-1 are disposed at the opposite positions to each other, the fifth shortest segmented rod 2E-1 and the sixth shortest segmented rod 2F-1 are disposed at the opposite positions to each other, and the seventh shortest segmented rod 2G-1 and the eighth shortest segmented rod 2H-1 are disposed at the opposite positions to each other, so that the influence of the potential gradient in the radial direction can be suppressed at the minimum. Namely, it is important that the next shortest segmented rod to the odd-numbered segmented rod is disposed at the position opposite to the odd-numbered segmented rod when seen from one end.

As described above, in the fifth embodiment, the principle and the effect have been described in the configuration in which in an octopole rod electrode that a multipole rod electrode configuring an ion guide is formed of eight rod electrodes, all the rod electrodes are divided into two parts at different positions in the axial direction.

From the first embodiment, the second embodiment, the fourth embodiment, and the fifth embodiment, in the multipole rod electrode in which all the rod electrodes are divided at different positions in the axial direction, the number of segments can be defined by Equation 1 where the number of the rod electrodes is P and the number of the rod electrodes divided is n. This value is similarly defined also in the number of the rod electrodes and the number of the rod electrodes divided in the case other than the described embodiments. Moreover, in the case where the number of rod electrodes is an even number, as similar to the described embodiments, it is important that the next shortest segmented rod to the odd-numbered segmented rod is disposed at the position opposite to the odd-numbered segmented rod when seen from one end.

$$\text{Number of segments} = P \times n - (P-1) \quad \text{(Equation 1)}$$

Sixth Embodiment

In a sixth embodiment, a configuration will be described in which in a hexapole rod electrode that a multipole rod electrode configuring an ion guide is formed of six rod electrodes, pairs of two rod electrodes at the opposite positions to each other are divided into three parts at the same position in the axial direction and different pairs are divided into three parts at different positions in the axial direction.

Figure 15:
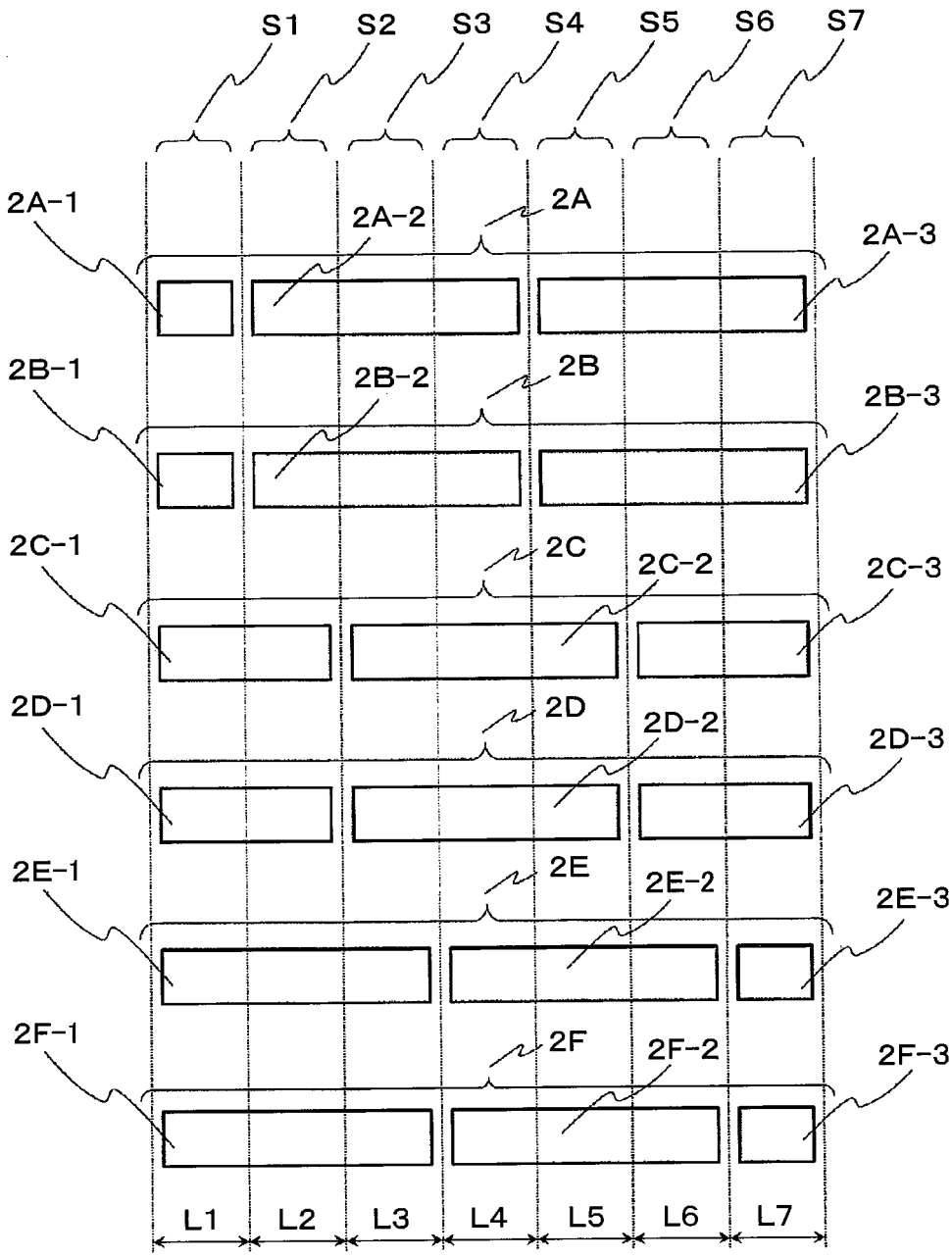
FIG. 15 is an illustration of positions to divide rod electrodes according to a sixth embodiment.

FIG. 15 is an illustration of positions to divide rod electrodes of a hexapole rod electrode using the present method. It is noted that as for the arrangement of the rod electrodes, the signs are the same as the signs of the rod electrodes (2A to 2F) shown in FIG. 11, and the detailed description of the embodiment is omitted in the drawing.

Among six rod electrodes 2A to 2F, two rod electrodes 2A and 2B, two rod electrodes 2C and 2D, and two rod electrodes 2E and 2F at the opposite positions to each other are divided into three parts at the same position in the axial direction, different pairs of the rod electrodes are divided into three parts at different positions in the axial direction, and the rod electrodes are divided into segmented rods 2A-1 to 2F-3, so that the rod electrodes can be seemingly divided into seven segments S1 to S7. In other words, as similar to the fourth embodiment, the rod electrodes can be divided into the segments S1 to S7 having seven types of different average potentials. The divided segments S1 to S7 at this time can also be expressed by segment lengths L1 to L7.

Also in the sixth embodiment, the effect similar to the effect in the fourth embodiment can be obtained, and the influence of the potential gradient in the radial direction can be reduced because the positions to divide the rod electrodes at the opposite positions to each other are matched in the axial direction.

As described above, in the sixth embodiment, the principle and the effect have been described in the configuration in which in a hexapole rod electrode that a multipole rod electrode configuring an ion guide is formed of six rod electrodes, pairs of two rod electrodes at the opposite positions to each other are divided into three parts at the same position in the axial direction and different pairs are divided into three parts at different positions in the axial direction.

Seventh Embodiment

In a seventh embodiment, a configuration will be described in which in an octopole rod electrode that a multipole rod electrode configuring an ion guide is formed of eight rod electrodes, pairs of two rod electrodes at the opposite positions to each other are divided into three parts at the same position in the axial direction and different pairs are divided into three parts at different positions in the axial direction.

Figure 16:
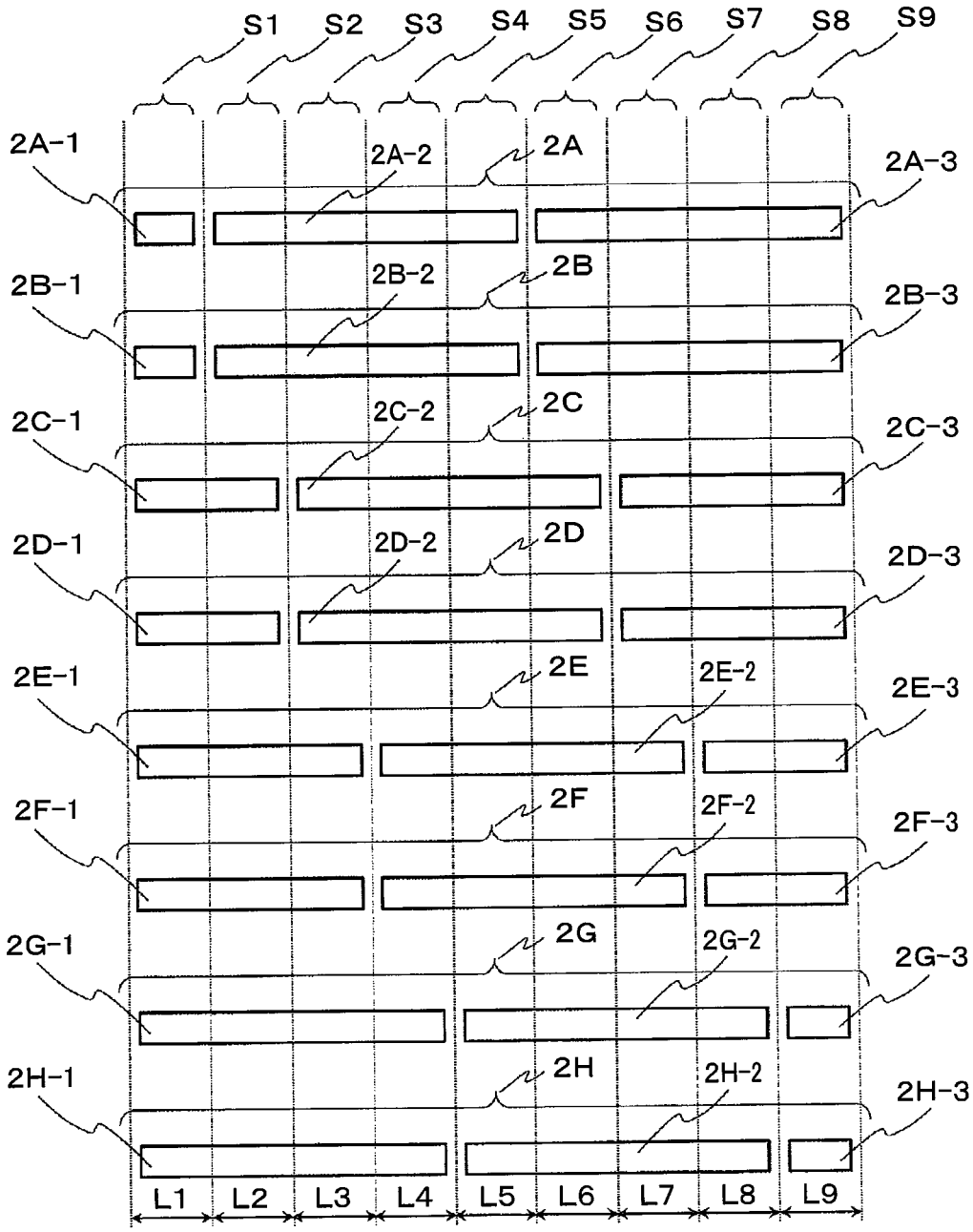
FIG. 16 is an illustration of positions to divide rod electrodes according to a seventh embodiment.

FIG. 16 is an illustration of positions to divide rod electrodes of an octopole rod electrode using the present method. It is noted that as for the arrangement of the rod electrodes, the sings are the same as the signs of the rod electrodes (2A to 2H) shown in FIG. 13, and the detailed description of the embodiment is omitted in the drawing.

Among eight rod electrodes 2A to 2H, two rod electrodes 2A and 2B, two rod electrodes 2C and 2D, two rod electrodes 2E and 2F, and two rod electrodes 2G and 2H at the opposite positions to each other are divided into three parts at the same position in the axial direction, different pairs of the rod electrodes are divided into three parts at different positions in the axial direction, and the rod electrodes are divided into segmented rods 2A-1 to 2H-3, so that the rod electrodes can be seemingly divided into nine segments S1 to S9. In other words, as similar to the fifth embodiment, the rod electrodes can be divided into the segments S1 to S9 having nine types of different average potentials. The divided segments S1 to S9 at this time can also be expressed by segment lengths L1 to L9.

Also in the seventh embodiment, the effect similar to the effect in the fifth embodiment can be obtained, and the influence of the potential gradient in the radial direction can be reduced because the positions to divide the rod electrodes at the opposite positions to each other are matched in the axial direction.

As described above, in the seventh embodiment, the principle and the effect have been described in the configuration in which in an octopole rod electrode that a multipole rod electrode configuring an ion guide is formed of eight rod electrodes, pairs of two rod electrodes at the opposite positions to each other are divided into three parts at the same position in the axial direction and different pairs are divided into three parts at different positions in the axial direction.

From the third embodiment, the sixth embodiment, and the seventh embodiment, in the multipole rod electrode in the configuration in which pairs of two rod electrodes of the multipole rod electrode at the opposite positions to each other are divided at the same position in the axial direction and different pairs of the rod electrodes are divided at different positions in the axial direction, the number of segments can be defined by Equation 2 where the number of the rod electrodes is P and the number of the rod electrodes divided is n. This value is similarly defined also in the number of the rod electrodes and the number of the rod electrodes divided in the case other than the described embodiments.

$$\text{Number of segments}=(P/2)\times n-((P/2)-1) \quad \text{(Equation 2)}$$

Eighth Embodiment

In an eighth embodiment, a configuration will be described in which a multipole rod electrode configuring an ion guide is a quadrupole rod electrode formed of four rod electrodes bent in an L-shape at a right angle and all of the rod electrodes are divided into three parts at different positions in the axial direction.

Figure 17:
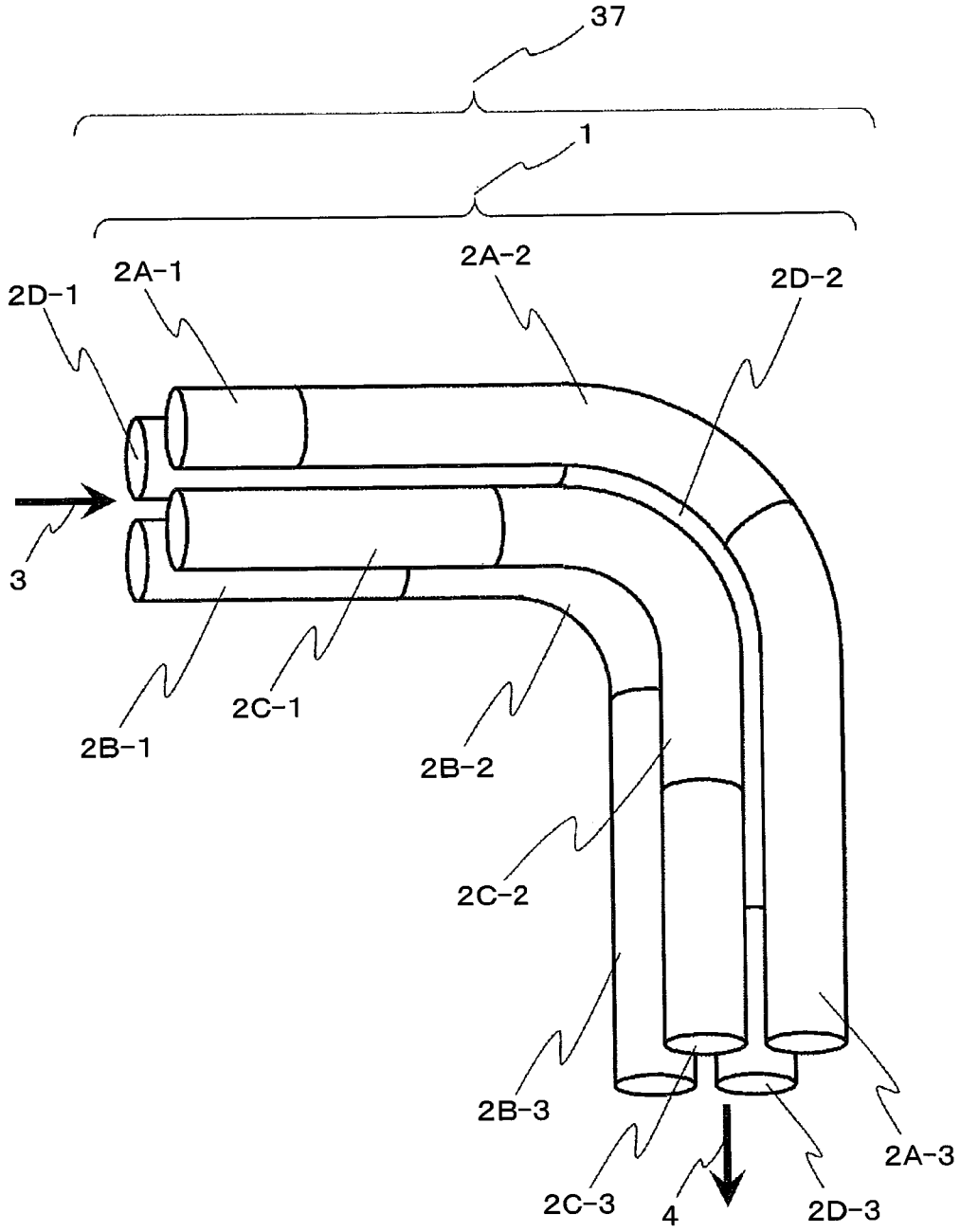
FIG. 17 is a block diagram of a device according to an eighth embodiment.

FIG. 17 is an illustration related to the arrangement of rod electrodes of a quadrupole rod electrode using the present method.

A multipole rod electrode 1 is configured of four rod electrodes 2A to 2D. The four rod electrodes 2A to 2D are divided into segmented rods 2A-1, 2A-2, 2A-3, 2B-1, 2B-2, 2B-3, 2C-1, 2C-2, 2C-3, 2D-1, 2D-2, and 2D-3. In the case where the multipole rod electrode 1 is used as an ion guide 37, ions 3 are introduced from one end of the multipole rod electrode 1 and passed through the multipole rod electrode 1, and ions 4 are ejected from the opposite side.

The detailed description of a method of applying a voltage to the multipole rod electrode 1 using a power supply and circuit 5 is omitted in the drawing. However, the method is almost similar to the method in the second embodiment. An anti-phase radio-frequency (RF) voltage 6 is applied to the rod electrodes 2A and 2B and the rod electrodes 2C and 2D, and different direct current voltages V1, V2, and V3 are applied to the segmented rods 2A-1, 2B-1, 2C-1, and 2D-1, the segmented rods 2A-2, 2B-2, 2C-2, and 2D-2, and the segmented rod 2A-3, 2B-3, 2C-3, and 2D-3, respectively.

The four rod electrodes 2A to 2D are divided into three parts at different positions in the axial direction, so that the rod electrodes can be seemingly divided into nine segments from Equation 1, although the detailed description is omitted in the drawing.

Although the effect of the embodiment is almost similar to the effect of the second embodiment, the multipole rod electrode is bent in an L-shape, so that linear noise components can be removed. Noise components include random noise and charged droplets, for example. The former goes straight because random noise is not electrically charged, whereas the latter cannot be passed along the multipole electrode 1 in an L-shape because the mass of charged droplets is beyond a mass range in which noise components are passed through the multipole rod electrode 1. On the other hand, as for ions, ions are converged on the center axis of the multipole rod electrode 1 due to the radio-frequency (RF) voltage 6, so that ions can be passed through the multipole rod electrode 1 along an L-shape.

Moreover, as in the third embodiment, a multipole rod electrode is provided in the configuration in which pairs of two rod electrodes of the multipole rod electrode at the opposite positions to each other are divided at the same position in the axial direction and different pairs of the rod electrodes are divided at different positions in the axial direction, so that the influence of the potential gradient in the radial direction can be reduced also in the multipole rod electrode in an L-shape as in the embodiment.

Furthermore, also in the configurations of various multipole rod electrodes such as the hexapole rod electrode and the octopole rod electrode shown in the fourth embodiment to the seventh embodiment, the multipole rod electrode in an L-shape as in the embodiment can be used.

As described above, in the eighth embodiment, the configuration has been described in which a multipole rod electrode configuring an ion guide is a quadrupole rod electrode formed of four rod electrodes bent in an L-shape at a right angle and the rod electrodes are divided.

Ninth Embodiment

In a ninth embodiment, a configuration will be described in which a multipole rod electrode configuring an ion guide is a quadrupole rod electrode formed of four rod electrodes bent in a U-shape at an angle of 180 degrees and all the rod electrodes are divided into four parts at different positions in the axial direction.

Figure 18:
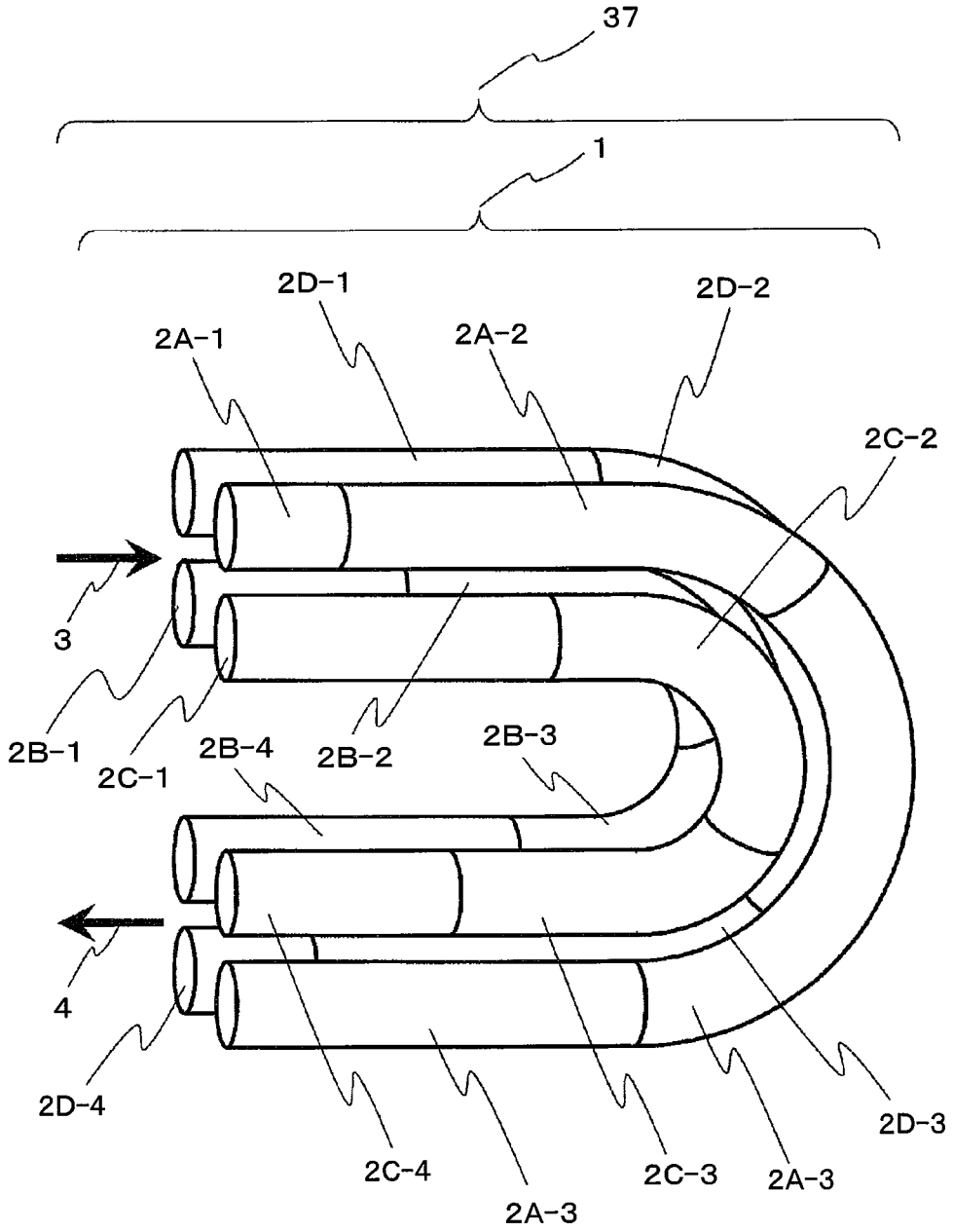
FIG. 18 is a block diagram of a device according to a ninth embodiment.

FIG. 18 is an illustration related to the arrangement of rod electrodes of a quadrupole rod electrode using the present method.

A multipole rod electrode 1 is configured of four rod electrodes 2A to 2D. The four rod electrodes 2A to 2D are divided into segmented rods 2A-1, 2A-2, 2 A-3, 2A-4, 2B-1, 2B-2, 2B-3, 2B-4, 2C-1, 2C-2, 2C-3, 2C-4, 2D-1, 2D-2, 2D-3, and 2D-4. In the case where the multipole rod electrode 1 is used as an ion guide 37, ions 3 are introduced from one end of the multipole rod electrode 1 and passed through the multipole rod electrode 1, and ions 4 are ejected from the opposite side.

The detailed description of a method of applying a voltage to the multipole rod electrode 1 using a power supply and circuit 5 is omitted in the drawing. However, the method is almost similar to the method in the second embodiment. An anti-phase radio-frequency (RF) voltage 6 is applied to the rod electrodes 2A and 2B and the rod electrodes 2C and 2D, and different direct current voltages are applied to the segmented rods 2A-1, 2B-1, 2C-1, and 2D-1, the segmented rods 2A-2, 2B-2, 2C-2, and 2D-2, the segmented rod 2 A-3, 2B-3, 2C-3, and 2D-3, and the segmented rods 2A-4, 2B-4, 2C-4, and 2D-4.

The four rod electrodes 2A to 2D are divided into four parts at different positions in the axial direction, so that the rod electrodes can be seemingly divided into 13 segments from Equation 1, although the detailed description is omitted in the drawing.

Although the effect of the embodiment is almost similar to the effect of the eighth embodiment, the multipole rod electrode is bent in a U-shape, so that a multipole rod electrode that can remove linear noise components can be mounted in a space saving manner.

Moreover, as in the third embodiment, a multipole rod electrode is provided in the configuration in which pairs of two rod electrodes of the multipole rod electrode at the opposite positions to each other are divided at the same position in the axial direction and different pairs of the rod electrodes are divided at different positions in the axial direction, so that the influence of the potential gradient in the radial direction can be reduced also in the multipole rod electrode in a U-shape as in the embodiment.

Furthermore, also in the configurations of various multipole rod electrodes such as the hexapole rod electrode and the octopole rod electrode shown in the fourth embodiment to the seventh embodiment, the multipole rod electrode in a U-shape as in the embodiment can be used.

As described above, in the ninth embodiment, the configuration has been described in which a multipole rod electrode configuring an ion guide is a quadrupole rod electrode formed of four rod electrodes bent in a U-shape at a right angle and the rod electrodes are divided.

Tenth Embodiment

In a tenth embodiment, a mass spectrometer will be described in a configuration in which an ion guide using the multipole rod electrode as described in the first embodiment to the ninth embodiment is functioned as an ion dissociation unit (Q2).

Figure 19:
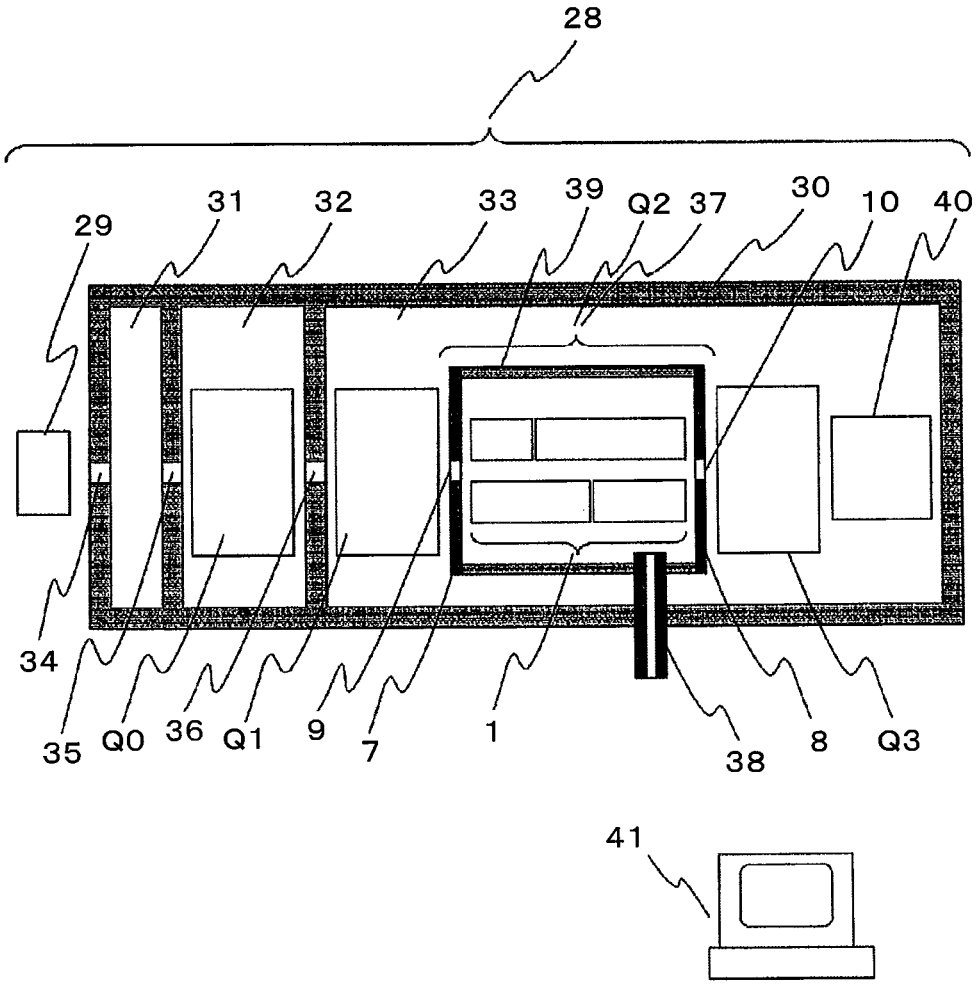
FIG. 19 is a block diagram of a device according to a tenth embodiment.

FIG. 19 is the configuration of a mass spectrometer 28 when an ion guide 37 is functioned as an ion dissociation unit Q2 according to the present method.

The mass spectrometer 28 is mainly configured of an ion source 29 and a vacuum chamber 30. For the ion source 29, ion sources using various ionization methods such as atmospheric pressure chemical ionization (APCI), electrospray ionization (ESI), and other methods can be used. The vacuum chamber 30 is separated into a first vacuum chamber 31, a second vacuum chamber 32, and a third vacuum chamber 33, in which air is discharged from the vacuum chambers separately through a vacuum pump (not shown) and pressures in the vacuum chambers are maintained in pressure ranges of a voltage of a few hundreds Pa or less, a voltage of a few Pa or less, and a voltage of 0.1 Pa or less, respectively. Moreover, the mass spectrometer 28 includes a control unit 41 that accepts input of an instruction from a user and performs controlling voltages, for example. More specifically, the mass spectrometer 28 includes an input/output unit, a memory, and so on, and includes software necessary to manipulate power supplies to control the voltages of the mass spectrometer 28.

Ions generated at the ion source 29 are passed through a first aperture 34, and introduced into the first vacuum chamber 31. After that, the ions are passed through a second aperture 35, and introduced into the second vacuum chamber 32. The ions are then passed through an ion transport unit Q0. For the ion transport unit Q0, a multipole rod electrode configured of a plurality of rod electrodes, an electrostatic lens configured of a plurality of disc-like electrodes, or the like can be used. The ions passed through the ion transport unit Q0 are passed through a third aperture 36, and introduced into the third vacuum chamber 33. The ions are then passed through a first ion selection unit Q1. For the first ion selection unit Q1, a quadrupole mass filter (QMF) configured of four rod electrodes or the like is used, in which only ions having a specific mass-to-charge ratio (m/z) are separated from the ions introduced into the first ion selection unit Q1 and the ions are passed through the first ion selection unit Q1. The ions having a specific m/z and passed through the first ion selection unit Q1 are introduced into the ion guide 37. Since the ion guide 37 according to the present method is functioned as the ion dissociation unit Q2, the ion guide 37 is mainly configured of a multipole rod electrode 1, an inlet electrode 7, an outlet electrode 8, and so on. For the multipole rod electrode 1, the multipole rod electrode 1 as described in the first embodiment to the ninth embodiment can be used. Ions 3 introduced from an opening 9 of the inlet electrode 7 are dissociated by causing the ions to collide against a neutral gas introduced from a pipe 38. Ions 4 are then ejected from an opening 10 of the outlet electrode 8. For the neutral gas, nitrogen, helium, argon, or the like is used. The ion dissociation unit Q2 includes a case 39 because it is necessary to fill the inside of the ion dissociation unit Q2 with a neutral gas, and the inside is maintained at a voltage of a few Pa or less. The ions 4 passed through the ion guide 37 are introduced into a second ion selection unit Q3. For the second ion selection unit Q3, a QMF configured of four rod electrodes or the like is used, in which the ions introduced into the second ion selection unit Q3 are separated according to the m/z and the ions are passed through the second ion selection unit Q3. The ions passed through the second ion selection unit Q3 are detected at a detector 40. For the detector 40, generally, a method is used such as a photomultiplier tube or a multi-channel plate (MCP) that converts ions into electrons, amplifies the electrons, and then detects electrons.

According to the present method, the ion time of flight in the ion dissociation unit Q2 is shortened, so that it is possible to perform analysis at high throughput.

As described above, in the tenth embodiment, the mass spectrometer has been described in the configuration in which the ion guide as described in the first embodiment to the ninth embodiment is functioned as an ion dissociation unit.

Eleventh Embodiment

In an eleventh embodiment, a mass spectrometer will be described in a configuration in which an ion guide using the multipole rod electrode as described in the first embodiment to the ninth embodiment is functioned as an ion transport unit (Q0).

Figure 20:
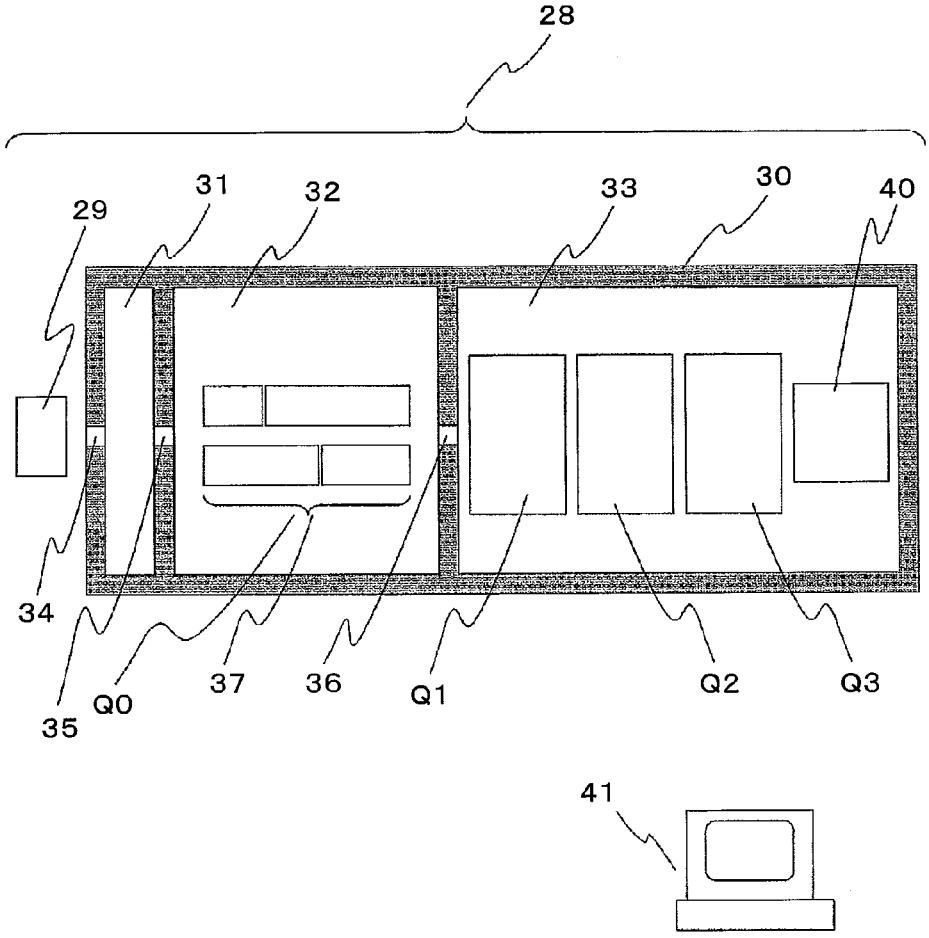
FIG. 20 is a block diagram of a device according to an eleventh embodiment.

FIG. 20 is the configuration of a mass spectrometer 28 when an ion guide 37 is functioned as an ion transport unit Q0 according to the present method.

The mass spectrometer 28 is mainly configured of an ion source 29 and a vacuum chamber 30. For the ion source 29, ion sources using various ionization methods such as APCI, ESI, and other methods can be used. The vacuum chamber 30 is separated into a first vacuum chamber 31, a second vacuum chamber 32, and a third vacuum chamber 33, in which air is discharged from the vacuum chambers separately through a vacuum pump (not shown) and pressures in the vacuum chambers are maintained in pressure ranges of a voltage of a few hundreds Pa or less, a voltage of a few Pa or less, and a voltage of 0.1 Pa or less, respectively.

Ions generated at the ion source 29 are passed through a first aperture 34, and introduced into the first vacuum chamber 31. After that, the ions are passed through a second aperture 35, and introduced into the second vacuum chamber 32. The ions are then passed through an ion transport unit Q0. For the ion transport unit Q0, the multipole rod electrode 1 as described in the first embodiment to the ninth embodiment can be used, and a method of applying a voltage or the like is basically the same. However, the voltage conditions such as the radio-frequency (RF) voltage 6 and the direct current voltages V1 to V3 are generally different as compared with the case where the ion guide 37 is used as an ion dissociation unit Q2. Moreover, an inlet electrode 7, an outlet electrode 8, a pipe 38, a case 39, and so on used in the ion dissociation unit Q2 may not be provided.

The ions passed through the ion transport unit Q0 are passed through a third aperture 36, and introduced into the third vacuum chamber 33. The ions are then passed through a first ion selection unit Q1. For the first ion selection unit Q1, a QMF configured of four rod electrodes or the like is used, in which only ions having a specific m/z are separated from the ions introduced into the first ion selection unit Q1 and the ions are passed through the first ion selection unit Q1. The ions having a specific m/z and passed through the first ion selection unit Q1 are introduced into the ion dissociation unit Q2. The ions passed through the ion dissociation unit Q2 are introduced into a second ion selection unit Q3. For the second ion selection unit Q3, a QMF configured of four rod electrodes or the like is used, in which the ions introduced into the second ion selection unit Q3 are separated according to the m/z and the ions are passed through the second ion selection unit Q3. The ions passed through the second ion selection unit Q3 are detected at a detector 40. Moreover, the mass spectrometer 28 includes a control unit 41 that accepts input of an instruction from a user and performs controlling voltages, for example.

According to the present method, the ion time of flight in the ion transport unit Q0 is shortened, so that it is possible to perform analysis at high throughput.

Moreover, the present method may be combined with the tenth embodiment. In other words, such a configuration may be possible in which the ion guide 37 as described in the first embodiment to the ninth embodiment is used for both of the ion transport unit Q0 and the ion dissociation unit Q2.

As described above, in the eleventh embodiment, the mass spectrometer has been described in the configuration in which the ion guide as described in the first embodiment to the ninth embodiment is functioned as an ion transport unit.

Twelfth Embodiment

In a twelfth embodiment, an embodiment will be described in a configuration in which a multipole rod electrode configuring an ion guide is a quadrupole rod electrode formed of four rod electrodes, all the rod electrodes are divided into two parts at different positions in the axial direction, and the length of divided segments is shorter on the inlet side into which ions are introduced.

Figure 21:
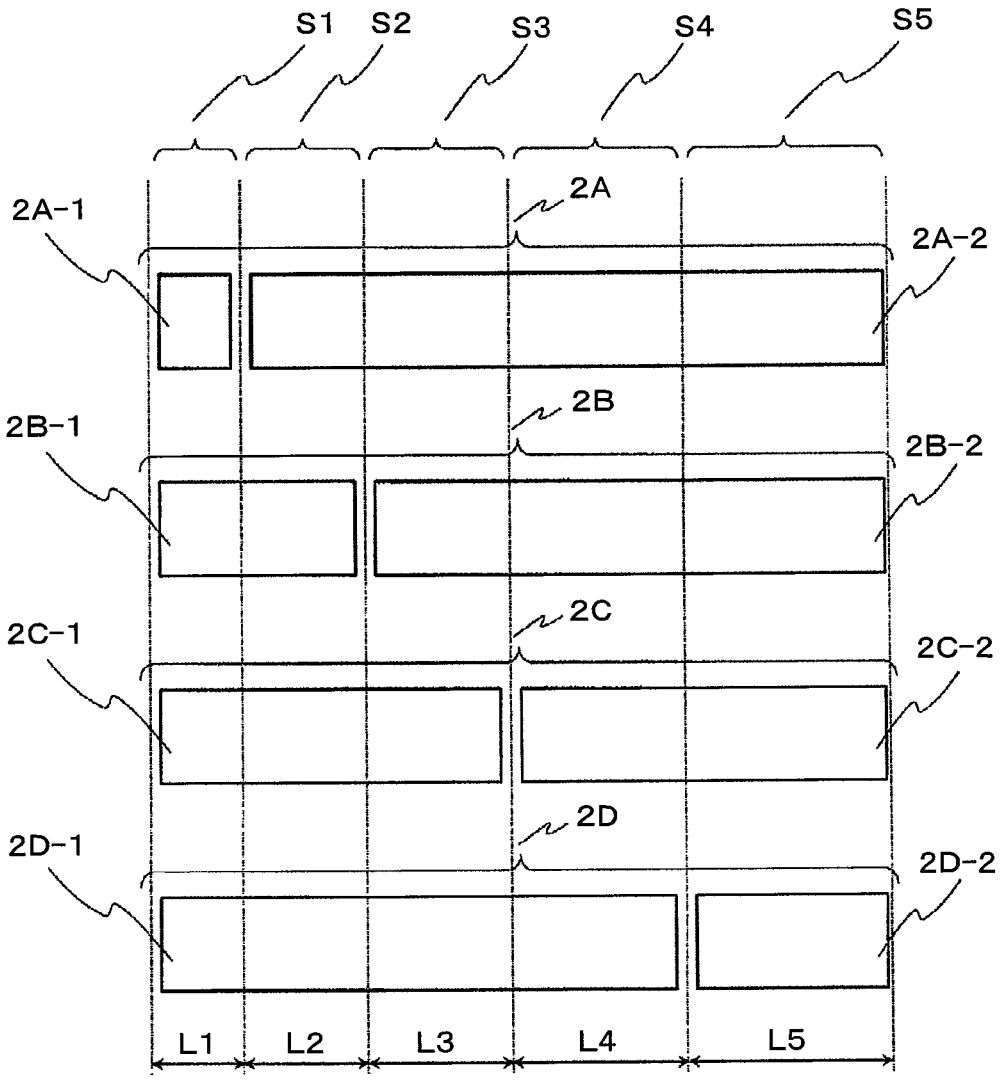
FIG. 21 is an illustration of positions to divide rod electrodes according to a twelfth embodiment.

FIG. 21 is an illustration of positions to divide rod electrodes of a quadrupole rod electrode using the present method. It is noted that as for the arrangement of the rod electrodes, the signs are the same as the signs of the rod electrodes (2A to 2D) shown in FIG. 1, and the detailed description of the embodiment is omitted in the drawing. Moreover, since a method of applying a voltage using a power supply and circuit 5 is almost the same as the method in FIG. 1, the description is omitted in the embodiment.

Four rod electrodes 2A to 2D are divided into two parts at different positions in the axial direction, so that the rod electrodes can be seemingly divided into five segments S1 to S5. In other words, as similar to the first embodiment, the rod electrodes can be divided into the segments S1 to S5 having five types of different average potentials. The divided segments S1 to S5 at this time can also be expressed by segment lengths L1 to L5. In the embodiment, the length of the segment S1 is the shortest segment length L1 among all the segments S1 to S5.

Particularly, in the device configuration as described in FIG. 19, in order to increase ion introduction efficiency when ions 3 passed through a first ion selection unit Q1 are introduced into an ion dissociation unit Q2, a direct current voltage Vin applied to an inlet electrode 7 is sometimes set to a value lower than the value of a direct current voltage V1. When the segment length L1 is too long in the state of the condition Vin<V1, a flat potential gradient partially occurs as the result 13 that the rod electrodes are divided into three parts in FIG. 4, and ions are not efficiently accelerated. In some cases, ions come to a halt. Moreover, there is also the case where the potential difference between the direct current voltage Vin and the direct current voltage V1 causes ions to flow backward. Therefore, desirably, the segment length L1 is set to about 10 mm or less. In FIG. 21, although the relationship between the segment lengths is L1<L2<L3<L4<L5, all the segment lengths may be the same length. Furthermore, the same segment lengths may exist among the segment lengths L1 to L5. However, in the case where all the segment lengths are set to a segment length of 10 mm or less, the overall length is restricted depending on the number of the rod electrodes divided. In the case where it is desired to secure a relatively long overall length by a fewer number of the rod electrodes divided, such a scheme is necessary as shown in FIG. 21 in which the segment length L1 at a location near the inlet electrode 7 is set short whereas the segment length that is located far from the inlet electrode 7 and less affected by the direct current voltage Vin is set longer than L1 depending on locations, for example.

It is noted that the present method is also applicable to a configuration in which the number of the rod electrodes divided is other than two. Moreover, the present method is also applicable to multipole rod electrodes such as a hexapole rod electrode and an octopole rod electrode other than a quadrupole rod electrode. Furthermore, the present method is also applicable to a configuration in which pairs of two rod electrodes of the multipole rod electrode at the opposite positions to each other are divided at the same position in the axial direction and different pairs of the rod electrodes are divided at different positions in the axial direction. In addition, the present method is also applicable not only to the ion dissociation unit Q2 but also to the ion transport unit Q0.

As described above, in the twelfth embodiment, such an embodiment has been described in which a multipole rod electrode configuring an ion guide is a quadrupole rod electrode formed of four rod electrodes, all the rod electrodes are divided into two parts at different positions in the axial direction, and the length of divided segments is shorter on the inlet side into which ions are introduced.

Thirteenth Embodiment

In a thirteenth embodiment, a mass spectrometer will be described in a configuration in which an ion guide using the multipole rod electrode as described in the first embodiment to the ninth embodiment is functioned as a second ion selection unit (Q3).

Figure 22:
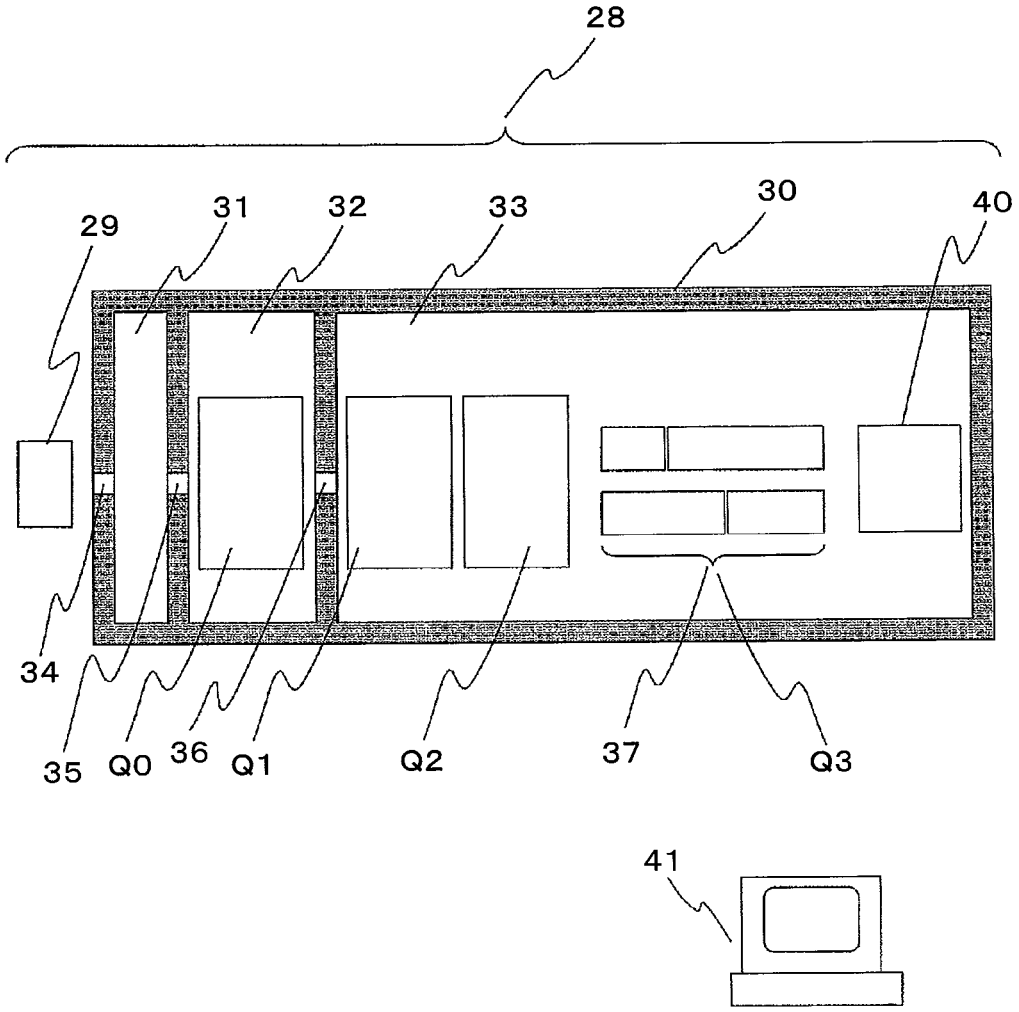
FIG. 22 is a block diagram of a device according to thirteenth embodiment.

FIG. 22 is the configuration of a mass spectrometer 28 when an ion guide 37 is functioned as a second ion selection unit Q3 according to the present method.

The mass spectrometer 28 is mainly configured of an ion source 29 and a vacuum chamber 30. For the ion source 29, ion sources using various ionization methods such as APCI, ESI, and other various methods can be used. The vacuum chamber 30 is separated into a first vacuum chamber 31, a second vacuum chamber 32, and a third vacuum chamber 33, in which air is discharged from the vacuum chambers separately through a vacuum pump (not shown) and pressures in the vacuum chambers are maintained in pressure ranges of a voltage of a few hundreds Pa or less, a voltage of a few Pa or less, and a voltage of 0.1 Pa or less, respectively.

Ions generated at the ion source 29 are passed through a first aperture 34, and introduced into the first vacuum chamber 31. After that, the ions are passed through a second aperture 35, and introduced into the second vacuum chamber 32. The ions are then passed through an ion transport unit Q0. For the ion transport unit Q0, a multipole rod electrode configured of a plurality of rod electrodes, an electrostatic lens configured of a plurality of disc-like electrodes, or the like can be used. The ions passed through the ion transport unit Q0 are passed through a third aperture 36, and introduced into the third vacuum chamber 33. The ions are then passed through a first ion selection unit Q1. For the first ion selection unit Q1, a QMF configured of four rod electrodes or the like is used, in which only ions having a specific m/z are separated from the ions introduced into the first ion selection unit Q1 and the ions are passed through the first ion selection unit Q1. The ions having a specific m/z and passed through the first ion selection unit Q1 are introduced into an ion dissociation unit Q2. The ions passed through the ion dissociation unit Q2 are introduced into the second ion selection unit Q3. For the second ion selection unit Q3, the multipole rod electrode 1 as descried in the first embodiment to the ninth embodiment and the twelfth embodiment can be used. In the second ion selection unit Q3 according to the embodiment, the multipole rod electrode 1 is operated as an ion trap. The ion trap has a function that temporarily accumulates the introduced ions in the inside and then ejects ions according to individual ion mass-to-charge ratios. The ions ejected from the second ion selection unit Q3 are detected at a detector 40. In the case where the second ion selection unit Q3 is used as an ion trap, it is necessary to fill the inside of the multipole rod electrode 1 with a neutral gas at a voltage of a few Pa or less. Thus, although an inlet electrode 7, an outlet electrode 8, a pipe 38, a case 39, and so on are sometimes used, which are used as in the ion dissociation unit Q2, the components are not necessarily required, and the components are not shown in FIG. 22 particularly. Moreover, the mass spectrometer 28 includes a control unit 41 that accepts input of an instruction from a user and performs controlling voltages, for example.

A method of applying a voltage to the multipole rod electrode 1 using a power supply and circuit 5 is almost the same as the method in FIG. 1, and a potential gradient can be generated in the axial direction. This potential gradient can collect ions on the outlet direction, so that the ejection speed of ions can be accelerated, and analysis at high throughput is made possible. Moreover, a radio-frequency (RF) voltage 6 is applied through capacitors C1 to C4, so that the radio-frequency (RF) voltage 6 of different voltage amplitude values can be applied across segmented rods 2A-1, 2B-1, 2C-1, and 2D-1 in the previous stage and segmented rods 2A-2, 2B-2, 2C-2, and 2D-2 in the subsequent stage. Also in the voltage amplitude value of the radio-frequency (RF) voltage 6, the voltage value is changed like a gradient in the axial direction as similar to the direct current voltage. The m/z of ions stably accumulated in a quadrupole rod electrode depends on the voltage amplitude value of the radio-frequency (RF) voltage 6. Thus, according to the present method, ions can be distributed in the axial direction of the multipole rod electrode 1 depending on the m/z. As a result, the influence of the space charges in the multipole rod electrode 1 can be reduced.

Furthermore, the present method can also be combined with the tenth embodiment or the eleventh embodiment. In addition, the multipole rod electrode 1 according to the embodiment may be applied to the first ion selection unit Q1.

As described above, in the thirteenth embodiment, the mass spectrometer has been described in the configuration in which the ion guide as described in the first embodiment to the ninth embodiment and the twelfth embodiment is functioned as a second ion selection unit (Q3).

REFERENCE SIGNS LIST

1 Multipole rod electrode
2A to 2H Rod electrode
2A-1 to 2H-3 Segment rod
3 Ions
4 Ions
5 Power supply and circuit
6 Radio-frequency (RF) voltage
7 Inlet electrode
8 Outlet electrode
9 Opening
10 Opening
11 Simulation result of the central potential
12 Result of the present method
13 Result divided into three parts
14 Simulation result of the ion time of flight
15 Result at a potential difference of 10 V
16 Result at a potential difference of 5 V
17 Result at a potential difference of 2 V
18 Result at a potential difference of 1 V
19 Result at a potential difference of 0.5 V
20 Result at a potential difference of 0.2 V
21 Result at a potential difference of 0.1 V
22 Result at a potential difference of 0 V
23 Simulation result of an LMCO lower limit
24 Result at a potential difference of 5 V
25 Result at a potential difference of 2 V
26 Result at a potential difference of 1 V
27 Result at a potential difference of 0.5 V
28 Mass spectrometer
29 Ion source
30 Vacuum chamber
31 First vacuum chamber
32 Second vacuum chamber
33 Third vacuum chamber
34 First aperture
35 Second aperture
36 Third aperture
37 Ion guide
38 Pipe
39 Case
40 Detector
41 Control unit
V1 to V3 Direct current voltage
R1 to R6 Resister
C1 to C6 Capacitor
S1 to S9 Segment
L1 to L9 Segment length
G1 to G2 Gap distance
Vin Direct current voltage
Vout Direct current voltage
r0 Radius of an inscribed circle
D Rod diameter
Q0 Ion transport unit
Q1 First ion selection unit
Q2 Ion dissociation unit
Q3 Second ion selection unit

The invention claimed is:

1. A mass spectrometer comprising:

an ion guide including a multipole rod electrode which includes a plurality of rods;

a power supply unit configured to apply a voltage to the multipole rod electrode; and a control unit configured to control the power supply unit, wherein each of the rods are divided into rod segments at positions different from each other in an axial direction.

2. The mass spectrometer according to claim 1,
wherein a first group of two or more of the rods are each divided into rod segments at a first position in the axial direction and a second group of two or more of the rods are each divided into rod segments at a second position, different from the first position, in the axial direction.

3. The mass spectrometer according to claim 1,
wherein each rod has one or more regions in the axial direction each having a different average potential.

4. The mass spectrometer according to claim 1,
wherein the power supply unit includes:
a radio-frequency power supply configured to apply a radio-frequency (RF) voltage to the multipole rod electrode;
a first direct current power supply connected to a first segmented rod group of the multipole rod electrode consisting of one or more of the rods; and
a second direct current power supply connected to a second segmented rod group consisting of rods different from the rods of the first segmented rod group in the axial direction and configured to apply a direct current voltage having a value different from a value of the first direct current power supply.

5. The mass spectrometer according to claim 4,
wherein for a magnitude of the direct current voltage, an absolute value of a value of a voltage applied to a segmented rod group on an ion introducing side is greater than an absolute value of a value of a voltage applied to a segmented rod group on an ion ejecting side.

6. The mass spectrometer according to claim 1,
of the rod segments disposed at the ion introducing side, the rod segment having the shortest length of a rod in the axial direction is disposed opposite, in a radial direction of the multiple rod electrode, to the rod segment having the next shortest length of another rod.

7. The mass spectrometer according to claim 1,
wherein the ion guide includes:
an inlet electrode disposed on an ion introducing side of the multipole rod electrode; and
an outlet electrode disposed on an ion ejecting side.

8. The mass spectrometer according to claim 1,
wherein
the multiple rod electrode has different regions in the axial direction each extending to an adjacent division position of any rod of the multiple rod electrode or one of the ion introducing side and the ion exit side of the multiple rod electrode, the distance in the axial direction of the region closest to the ion introducing side is the shortest and the distance of the other regions increases in the axial direction based on the distance of the region from the ion introducing side.

9. The mass spectrometer according to claim 1, wherein the multipole rod electrode is any one of a quadrupole rod electrode, a hexapole rod electrode, and an octopole rod electrode.

10. The mass spectrometer according to claim 1, wherein the multipole rod electrode is formed of a rod electrode whose axial direction is changed so that an ion introducing direction is different from an ion ejecting direction.

11. The mass spectrometer according to claim 10, wherein the multipole rod electrode is in an L-shape or U-shape.

12. The mass spectrometer according to claim 1, wherein:
the ion guide includes a supply pipe of a gas; and
introduced ions are dissociated by causing the ions to collide against the gas.

13. The mass spectrometer according to claim 1, wherein the ion guide separates ions at every mass by controlling the radio-frequency power supply and ejects ions.

14. The mass spectrometer according to claim 1, wherein the multipole rod electrode includes:
a first direct current power supply configured to apply a first direct current voltage to a first segmented rod group on an ion introducing side, the first segmented rod group configured of the multipole rod electrode divided into two segmented rods at different positions in the axial direction; and
a second direct current power supply configured to apply a second direct current voltage lower than the first direct current voltage to a second segmented rod group on an ion ejecting side.

15. A mass spectrometer comprising:
an ion source configured to generate ions:
an ion transport unit configured to transport ions from the ion source;
a first ion selection unit configured to separate ions having a specific m/z from ions transported from the ion transport unit;
an ion dissociation unit configured to dissociate ions separated at the ion selection unit;
a second ion selection unit configured to accumulate ions dissociated at the ion dissociation unit and selectively eject ions according to a mass; and
a detector configured to detect ions ejected from the second ion selection unit,
wherein at least any one of the ion transport unit, the ion dissociation unit, the first ion selection unit, and the second ion selection unit is the ion guide according to claim 1.

* * * * *